United States Patent [19]

LaBarge et al.

[11] Patent Number: 4,685,849

[45] Date of Patent: Aug. 11, 1987

[54] METHOD FOR MAKING AN EASY OPENING CONTAINER END CLOSURE

[75] Inventors: Robert L. LaBarge, Ben Avon; Robert E. Heffner, Lower Burrell, both of Pa.

[73] Assignee: Aluminum Company of America, Pittsburgh, Pa.

[21] Appl. No.: 892,796

[22] Filed: Aug. 4, 1986

Related U.S. Application Data

[62] Division of Ser. No. 792,106, Oct. 28, 1985, Pat. No. 4,648,528, which is a division of Ser. No. 738,975, May 29, 1985, Pat. No. 4,580,692.

[51] Int. Cl.[4] ..... B21D 51/42

[52] U.S. Cl. ..... 413/22; 29/522 R; 220/240; 413/12; 413/17

[58] Field of Search ..... 413/12, 15, 16, 17, 413/22, 53, 67; 29/522; 220/240, 269, 270

[56] References Cited

U.S. PATENT DOCUMENTS

| | | | |
|---|---|---|---|
| 2,880,686 | 4/1959 | Higgin | 413/22 |
| 3,191,564 | 6/1965 | Fraze | 29/522 |
| 3,990,376 | 11/1976 | Schubert et al. | 413/17 |
| 4,018,178 | 4/1977 | Klein et al. | 413/17 |
| 4,202,287 | 5/1980 | Zundel | 413/16 |

*Primary Examiner*—Frederick R. Schmidt
*Assistant Examiner*—Robert Showalter
*Attorney, Agent, or Firm*—Max L. Williamson

[57] ABSTRACT

A closure for closing the open end of a container having contents therein which dissociate a gas therefrom. The closure is adapted to provide an opening for access to the contents. The opening is adapted for a snap assembly with a plastic cap to effect a substantially gas-tight seal of the opening under high pressures to enable resealing of the container after dispensing a portion of the contents.

12 Claims, 40 Drawing Figures

METHOD FOR MAKING AN EASY OPENING CONTAINER END CLOSURE

This application is a division of application Ser. No. 792,106, filed Oct. 28, 1985, now U.S. Pat. No. 4,648,528, which, in turn, is a division of application Ser. No. 738,975, filed May 29, 1985, now U.S. Pat. No. 4,580,692.

BACKGROUND

This invention relates to a cap for sealing a container having contents from which gas dissociates therein. The invention also relates to a cap which is adapted to provide an opening in the container to gain access to the contents as well as seal the opening thereafter. The invention further relates to a cap in combination with a container end suitable for sealing a container having contents from which gas dissociates therein, and a method of making such can end.

There has been a long-felt need for a snap-type cap which is effective for sealing and/or resealing a container having a gas dissociating substance, such as a carbonated beverage, for example, packaged therein. When a beverage container is opened, gas in the space between the beverage and the container end (referred to as head space) is immediately lost, and gas which subsequently dissociates from the beverage escapes as well. Any gas loss has an effect on the level of carbonation in the beverage and excessive loss may make the beverage unacceptable. A cap suitable for sealing or resealing must be effective in sealing to make the container substantially gas-tight, and it must also remain in sealing engagement at relatively high pressures. Since the level of carbonation from one beverage to another may vary substantially and internal pressure may also vary with other factors, such as temperature and head space above the beverage in the container, for example, it is not practical to establish a performance criteria for a beverage closure which will satisfy every potential use. Typically, however, a cap suitable for providing substantially gas-tight sealing of a beverage container should be able to retain approximately 90% of the level of carbonation in the beverage at the time of sealing for a period of 24 hours at a pressure of up to approximately 50 psi and with the beverage at room temperature. Many attempts to solve the problem of gas-tight sealing against such relatively high pressures with a snap-type cap have been made as evidenced by the number of patents which are directed thereto. A large number of proposals have been made to incorporate a central stopper with the cap, whereby the stopper acts against an interior surface of the bottle neck to effect a seal. Examples of but a few of such patents are Salminen U.S. Pat. No. 3,209,934, Lovell U.S. Pat. No. 3,254,785, Lohrer U.S. Pat. No. 3,266,652, Lohrer U.S. Pat. No. 3,438,529, Sachau U.S. Pat. No. 3,528,091, Grussen U.S. Pat. No. 3,858,742, Beck U.S. Pat. No. 3,866,784, Aichinger et al U.S. Pat. No. 3,872,993 and Pirgov et al U.S. Pat. No. 3,994,410. A number of other patents describe stopperless caps which rely solely upon the hoop strength of the cap skirt surrounding the bottle mouth to provide a seal between the cap and bottle. Examples are Gelbjerg-Hansen et al U.S. Pat. No. 3,247,993, Fuglsang-Madsen et al U.S. Pat. No. 3,247,994 and Ruprecht U.S. Pat. No. 3,371,814.

There has also been a long-felt need for sealing the opening in a carbonated beverage can. Easy-open ends as closures of carbonated beverage cans have become increasingly popular because their usage eliminates the need for a separate opener. A disadvantage, however, of many of the first embodiments of such closures is that the opening panel is a scored portion of the can end which is torn away and separated from the can by lifting and pulling on an attached tab. Careless discarding of the separated portion by users, particularly in public places, has contributed to an evergrowing litter problem, and a new generation of can ends commonly referred to as ecology ends has come into usage. The ecology ends, in general, feature an opening panel which is only partially severed from the end to provide an opening, and thus the panel remains attached to the can end. An example of such a can end is described in Heffner U.S. Pat. No. 3,618,815 wherein a V-shaped panel in the can end is forced into the can by an opening tab which is attached to the can end, and the panel remains attached along the hinge line.

An ever-increasing share of the 12-oz. carbonated beverage market is being packaged in cans rather than bottles for such reasons as more efficient use of shelf, storage and shipping space per ounce of beverage packaged, savings in container cost, and savings in cost in packaging the beverage in the container. In addition, cans are lighter and are less susceptible to breakage than glass bottles and provide a package having a longer shelf life than does a plastic bottle. Furthermore, it is readily apparent to any purchaser of carbonated beverages, whether beer or soft drinks, that practically all present-day 12-oz. size carbonated beverage cans feature an easy-open can end.

In spite of the above-noted advantages of metal cans over bottles, threaded bottles have generally been preferred for carbonated beverage containers larger than 12 ounces because such beverages are usually consumed in quantities of less than 12 ounces at a time, and bottles having a threaded closure thereon have been better adapted for resealing to retain carbonation in the beverage than have metal cans.

A variety of suggestions for providing a seal or reseal of a metal can end have been made. Ruskin U.S. Pat. No. 3,664,541, for example, describes a resilient body that is adapted to plug a conventional opening in the can end; that is, an opening made by lifting and pulling a tab connected to a portion of the can end defined by a score line. The end metal tears along the score line and the tab and weakened portion are then discarded, and Ruskin's device is used thereafter to seal the opening.

Another suggestion for resealing a can end is provided in Balocca et al U.S. Pat. No. 3,804,287. Balocca et al describes a can end having a dispensing aperture which is initially sealed with an adhesive patch adhered to the inner side of the end around the aperture. A resilient resealing member comprised of a plug on one end and a pull handle on the other end is disposed on the outside of the can end with the plug adhesively bonded to the sealing patch. When the handle is pulled, the patch portion defined by the periphery of the aperture is torn away to gain access to the container contents. The opening can then be resealed by pressing the plug downward into the aperture. The reseal is effected by an interference fit between the aperture edge and an upper portion of the plug which is larger in cross section than the aperture.

It may be seen that in plug seals, such as those described in the aforementioned Ruskin and Balocca et al patents, an effective reseal is dependent upon the interaction between the plug and the single layer of metal in the can end defining the opening. In such a case, the force required to wedge the plug into the opening sufficiently to resist being blown out of the opening by the internal pressure within a carbonated beverage can must be at least as much as the blow-out force generated by gas dissociating from the beverage. Since the blow-out force in such a container can exceed 35 pounds, the plug may be difficult to insert, as well as remove when it is desired to gain access to the can contents.

A combination opener-reclosure device for a can end is described in Wells et al U.S. Pat. No. 3,880,319. The device is movably attached to the can end and a plug portion is adapted to partially sever a flap defined by a line of weakness, such as a score line, for example, in the can end. With the opener-plug properly positioned in relation to the line of weakness, downward pressure on the device causes rupture of the can end along the line of weakness and the flap is hinged inwardly into the can. The device is then removed from the opening to provide access to the can contents. If only a portion of the contents are consumed, and it is desired to reclose the end, the plug portion is again moved to position it above the opening, and the plug portion is forced into the opening by applying downward pressure.

The foregoing examples describe but a few of the many proposals that have been made to provide an easy-open can end which can be resealed or reclosed.

SUMMARY OF THE PRESENT INVENTION

A cap of the present invention includes a top wall, a skirt therearound, and a ledge projecting from the skirt. The cap is engaged with the container by positioning it over an opening in the container and applying downward pressure to effect a snap engagement between the ledge and a lip on the container around the opening. A portion of the skirt above the ledge is adapted to fit in interference with a peripheral portion of the lip sufficient to enable gas dissociating from a beverage, for example, to accumulate at a faster rate than it escapes and thereby establish a low pressure seal. As the pressure increases from the dissociating gases, it acts against interior surfaces of the cap and, in particular, the top wall. A resulting force from such pressure acts through the skirt upon the ledge to engage the ledge against the container lip to prevent the cap from blowing off and also provide an effective gas-tight seal at high pressures in excess of the sealing limit of the initial low pressure seal. A cap of this invention may be adapted to provide an opening as well as seal such opening in an easy-open can end. A cap of this invention may also be adapted for attachment to the container in a manner which enables selective manipulation of the cap to a position overlying the opening or to a position remote therefrom.

It is an objective of this invention to provide an ecological container closure.

It is an objective of this invention to provide means for effecting a substantially gas-tight and liquid-tight seal of a container after an opening has been made therein.

It is also an objective of the invention to provide a container closure which can be opened without the need to use a separate opening device.

It is an advantage of this invention that an end wall of the sealing means is adapted to flex outwardly from the effect of internal pressure and thereby provide noticeable visual evidence of an effective seal.

It is also an advantage of this invention that the seal means is resistant against blow-off from the container from relatively high internal pressure, but the seal means can be applied to or removed from the opening with the use of a relatively small user force.

It is a further advantage of this invention that the seal means can be repeatedly applied and removed from the container opening without degrading the quality of the seal.

It is also an objective of this invention that means for sealing an opening include means for effecting the opening in the container.

It is also an objective of this invention that the opening means require the application of a minimal force by the user to effect an opening in the container.

It is an advantage in using an opener means of this invention that the user's hand is protected against contact with sharp edges of the container opening and the risk of the user cutting his or her hand is thereby avoided.

It is also an advantage in using this invention to effect an opening in a container that the spray of beverage which typically issues from the initial opening of a pressurized beverage container is captured or directed away from the user.

It is also an advantage of this invention that it can be positioned with respect to the opening in the container to protect against a user's lip contacting sharp edges of the opening when drinking from the container, and it is a further advantage that with the invention in such position free access of venting air is assured to thereby facilitate drinking from the container.

These and other objects and advantages will be more apparent with reference to the following description of a preferred embodiment and accompanying drawings.

DESCRIPTION OF A PREFERRED EMBODIMENT

For convenience, a preferred embodiment of a container closure of this invention will be described with reference to a can end closure, but it is to be understood that the invention may be used with other containers such as bottles or jars, for example.

Where the words "upwardly", "downwardly", "inwardly", "outwardly", "horizontal" and the like are used hereinafter, their meaning is to be taken with reference to a can in an upright position having a cap of this invention attached to the top end thereof.

Figure 1:
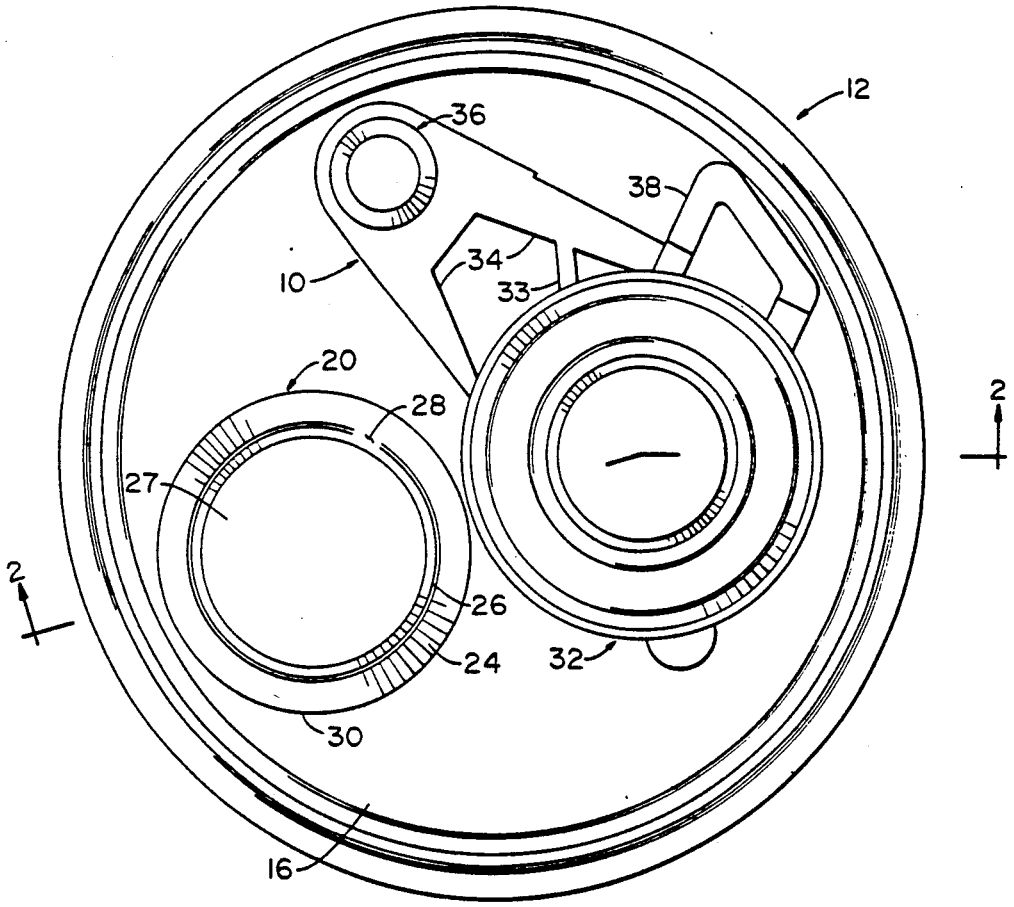
FIG. 1 is a plan view of a cap of this invention attached to a can end.
Figure 2:
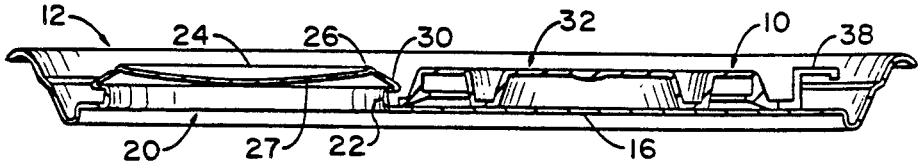
FIG. 2 is a cross-sectional view of the cap and can end shown in FIG. 1 along line 2—2.

Referring first to FIGS. 1 and 2, a cap of this invention 10 is shown attached to a can end closure 12 prior to the can end closure's engagement with a can body by double seaming.

Figure 3:
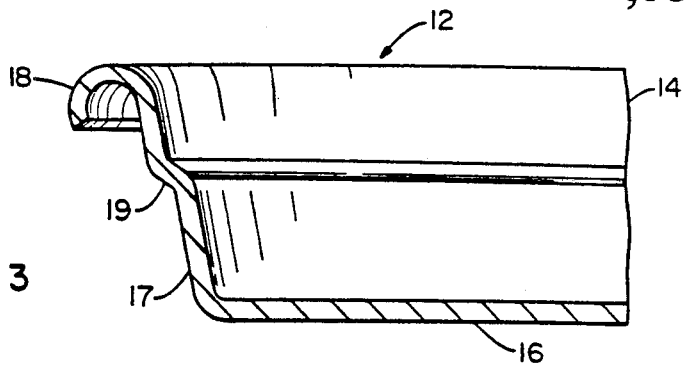
FIG. 3 is a cross-sectional view of the outer edge portion of a preferred can end blank to be used in making a can end for attachment of a cap of this invention.

A preferred blank for making a can end closure 12 for use with a cap of this invention is shown in FIG. 3. The can end blank 14 has a substantially flat end wall 16, a sidewall 17, flaring upwardly and outwardly from the peripheral edge of the end wall, and an annular flange 18 projecting upwardly and outwardly from the edge of the sidewall 17. An outwardly projecting step 19 intermediate the end wall 16 and annular flange 18 is provided in wall 17. The flange 18 is provided to attach the can end to a can body by double seaming.

Referring again to FIGS. 1 and 2, an upwardly projecting spout 20 is provided adjacent an edge of the end wall 16. The spout 20 is shown as having a circular cross section, but it could also be oval, ellipsoidal or any other shape in cross section suitable for snap engagement of the cap, as will be described later. The spout 20 is an integrally formed portion of the end wall 16 and includes an upwardly projecting sidewall 22 and a top wall 24. A score line 26 in the top wall 24 interrupted by a hinge portion 28 defines an opening panel portion 27 which is pressed inwardly into the can by fracturing the score line. The score line 26 may be continuous to permit complete separation of the panel 27 from the can end, but this is not preferred from an ecology or safety standpoint as a completely severed panel might pass through the opening and be carelessly discarded or swallowed. An annular lip 30 projects outwardly from the side wall at the juncture of the sidewall and the top wall. The method of making the spout 20 and features of the spout just noted will be described in detail later.

Figure 6:
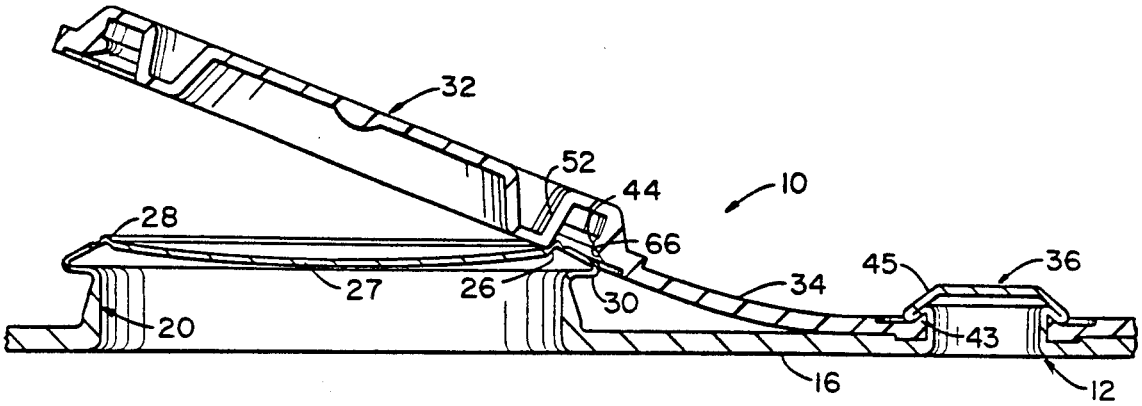
FIG. 6 is a cross-sectional view of a portion of a can end having a cap of this invention attached thereto and showing a seal portion of the cap positioned over a spout in the can end prior to effecting an opening in the spout end.
Figure 24:
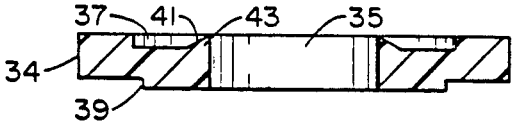
FIG. 24 is a cross-sectional view through a portion of an arm of a cap of this invention to be connected to a can end with a rivet.

The cap 10 is preferably molded in one piece using a plastic material having a low modulus of elasticity, such as low-density polyethylene, for example. The cap 10 is comprised of a seal portion 32, a pair of arms 34 angularly converging from the seal portion 32, and a tab 38 projecting outwardly from the seal portion 32 for convenience in manipulation of the cap. A strap 33 extends angularly from the arm 34 having the tab attached thereto to the seal portion to prevent caps from tangling during handling before attachment to the can end. Alternatively to a pair of arms, a single arm of sufficient strength could also be used. The cap is pivotally attached to the end wall 16 with a rivet 36 through an opening at the junction of the arms 34. As shown in FIG. 24, the converging arms 34 have an opening 35 to accommodate the rivet 36 and an annular ledge 39 on the bottom surface adjacent the opening to seat in a recess in the can end 16. An upper surface 41 sloping downwardly from the opening 35 into an annular recess 37 provides a lip 43 for engagement with the downwardly angled rivet flange 45, as shown in FIG. 6. The rivet flange is formed downwardly a controlled amount with respect to the lip 43 when the rivet is staked to attach the cap to the can end to insure that there is engagement between the rivet and the arms 34 sufficient to maintain the seal portion 32 in a fixed position, but also permit the seal portion to be rotated by hand about the rivet with relative ease. Preferably, the rivet 36 is an integrally formed portion of the end wall 16.

Figure 4:
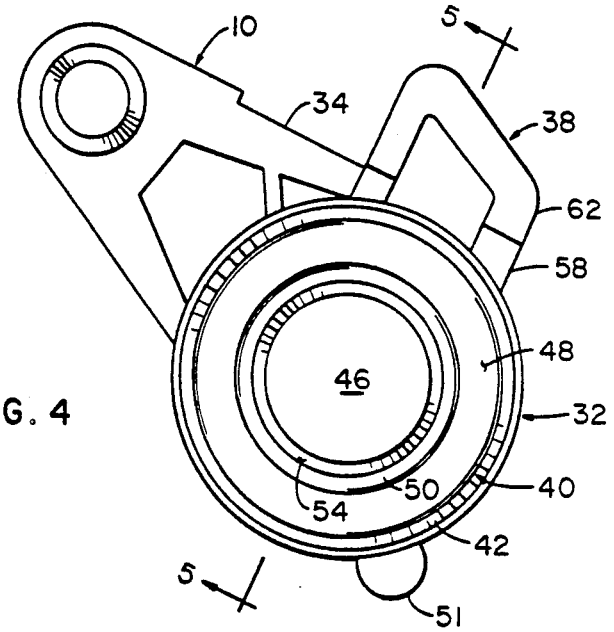
FIG. 4 is a plan view of a cap of this invention.
Figure 5:
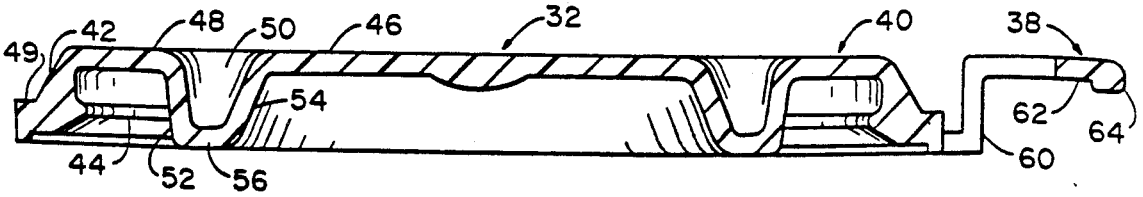
FIG. 5 is a cross-sectional view of the cap shown in FIG. 4 along line 5—5.

Referring now to FIGS. 4 and 5, the seal portion 32 of the cap 10 includes a top wall 40 and an outwardly flaring depending skirt 42. An annular lip 49 projects outwardly from the distal end of the skirt, and an annular wedge-shaped ledge 44 projects inwardly from the skirt 42 near the distal end of the skirt to engage the spout lip 30, as will be discussed later. A small tab 51 projecting outwardly from the annular lip 49 is provided to assist in lifting the seal portion from the can end when positioning it over the spout, as will be discussed later. The top wall 40 includes a central disc portion 46 and an annular outer portion 48 with an annular groove 50 therebetween. The groove is defined by a substantially cylindrical outer wall 52 depending from the inner edge of the annular portion 48, an inner wall 54 flaring outwardly and downwardly from the central planar disc portion 46, and an annular bottom wall 56 connecting the ends of the outer and inner walls 52, 54. The tab 38 is comprised of a handle portion 62 having its upper surface coplanar with the upper surface of the cap top wall 40 and substantially vertical connector legs 60, 60 connecting one end of the handle to an arm 34 and connecting the other handle end to a bar 58 extending outwardly from the annular ledge. A lip 64 depends from the outer edge of the handle 62 for ease in gripping.

Use of the invention will now be explained with reference to FIGS. 6, 7, 8 and 9. As has been noted heretofore, the cap 10 is attached to the can end 12 at a point spaced away from spout 20 by use of a rivet 36 and is positioned alongside the spout, as shown in FIG. 1. The opening in the spout 20 can be made by using a finger, pencil or some other tool to press downward on the opening panel 27 adjacent the score line 26 to fracture the end along the score line and thereafter push the opening panel into the can. It is a feature of this preferred embodiment, however, that the seal portion 32 may be used to conveniently make the opening. To open a can having a cap of this invention applied thereto, the seal portion 32 is moved to the position shown in FIG. 6 by inserting a finger or thumb nail under the lifting tab 51 (not shown in FIG. 6) and then lifting the seal portion and rotating the cap 10 about the riveted connection to clear the spout 20. The arms 34 flex so that the seal portion projects upwardly at an angle above the spout 20 with the sloped surface 66 of the ledge 44 resting on the lip 30 of the spout.

Figure 7:
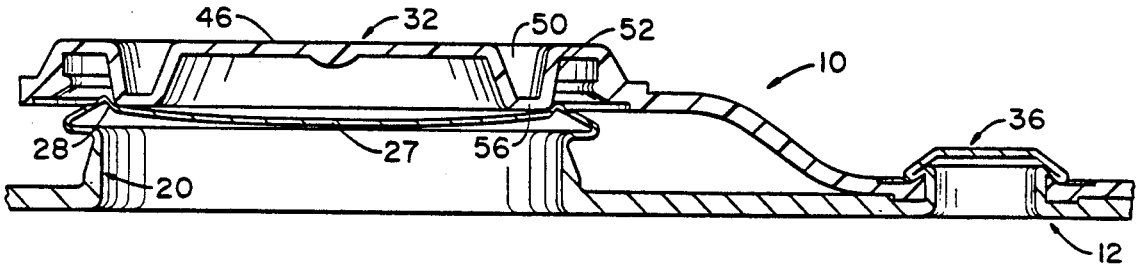
FIG. 7 is a cross-sectional view of the can end and cap shown in FIG. 6 with the seal portion pressed downward from the position shown in FIG. 6 to make opening contact with the spout end.
Figure 8:
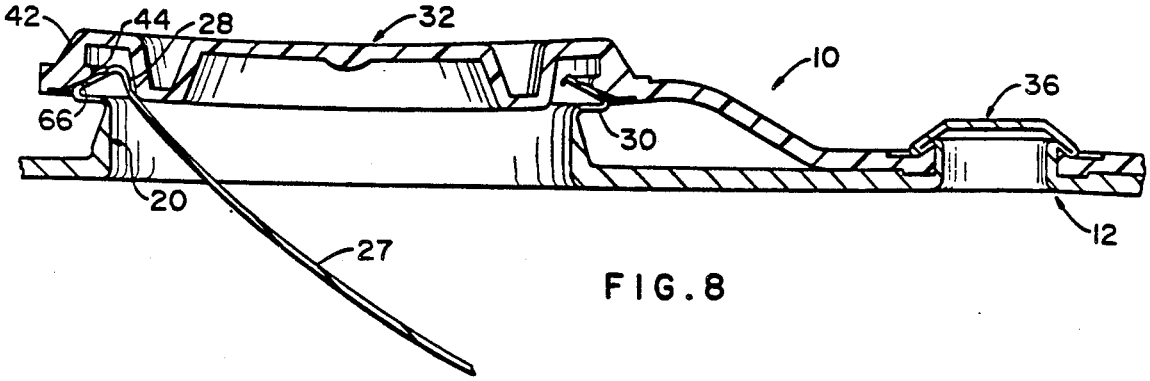
FIG. 8 is a cross-sectional view of the can end and cap shown in FIG. 7 with the seal portion pressed further downward from the position shown in FIG. 7 to effect a partial opening in the spout end.
Figure 9:
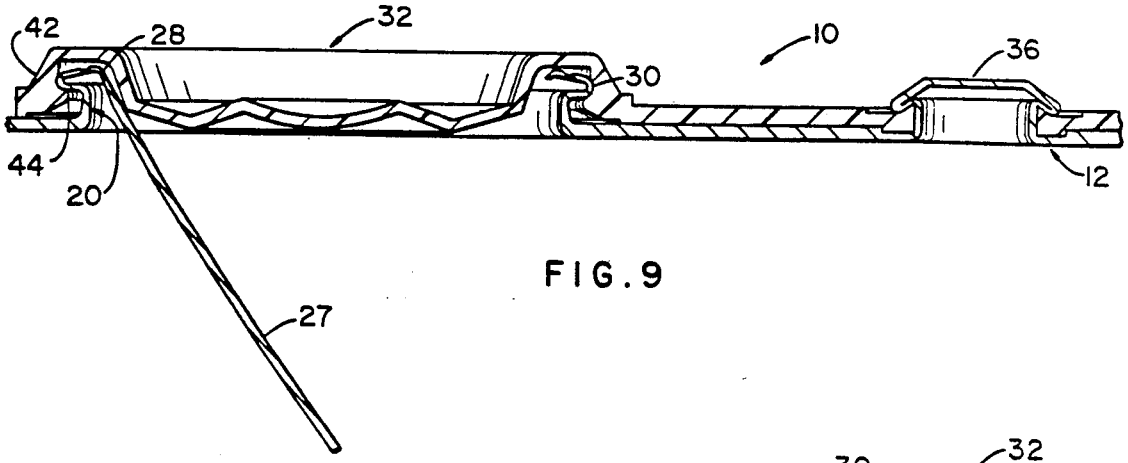
FIG. 9 is a cross-sectional view of the can end and cap shown in FIG. 8 with the seal portion pressed further downward from the position shown in FIG. 8 and with the partially severed opening panel of the spout end hinged downwardly into the can to effect an opening.

To open the can using the opener means, pressure is initially applied downwardly on the seal portion 32 which then assumes the position shown in FIG. 7 with the annular bottom wall 56 bearing against the spout opening panel 27 adjacent the score line 26. To initiate fracture of the score line 26, downward pressure is applied at any point along the annular groove 50 away from the hinge 28; however, the preferred point of initiating fracture is adjacent the hinge. The preferred point of applying pressure is near, but not on, the hinge since the amount of force required to initiate fracture at such a point is no greater than at any other point along the score line, and by applying pressure adjacent the hinge, the opening panel may be depressed inwardly to an adequate angle to dispense the container contents without the need for applying pressure to the central planar disc 46. Initial downward pressure brings the sloped surface 66 into contact with the spout lip 30 at the periphery thereof where the pressure is being applied and assists in aligning the seal portion 32 in the proper position over the spout with outer wall 52 adjacent to and concentric with score line 26, as may be seen in FIG. 6. It is advantageous to align the outer wall adjacent to the score line because such position requires the least amount of force to initiate rupture of the score line. The advantage of using the seal portion 32 rather than the user using his or her finger to make the opening may also be noted with reference to FIG. 7. Less downward force is required to initiate fracture of the score line because the force is concentrated adjacent the score line through the relatively rigid structure of wall 52 as compared to the relatively resilient meaty cushion on the user's fingertip. Furthermore, use of the seal portion protects the user from a finger cut in making the opening as well as containing or diverting away from the user the beverage spray issuing from the can at the initial point of fracture of the score line. After fracture has been initiated, further downward pressure along the groove and upon the central planar disc 46 causes severance along the score line to continue progressively from the point of initial fracture. As may be seen in FIG. 8, application of downward pressure on the seal portion 32 causes the skirt 42 to spring outwardly as the sloped surface 66 of the ledge 44 slides along the peripheral edge of the spout lip 30. Concurrently the opening panel 27 is forced inwardly into the can. Completion of the opening cycle is shown in FIG. 9 with the opening panel 27 extending into the can from the hinge 28 at an angle of approximately 75° from horizontal. It is noted, however, that for purposes of this invention, it is not essential that the opening panel 27 be extended inwardly to this extent. It has been determined that the can opening has satisfactory dispensing characteristics if the opening panel 27 is extended inwardly to at least a 45° angle from horizontal. FIG. 9 also shows the seal portion 32 firmly engaged with the spout 20. The downward pressure on the seal portion 32 required to effect an opening, as just described, is less than the pressure required to engage the seal portion 32 with the spout 20. If excessive pressure is applied, however, the skirt 42 may be sprung and pushed downward to an extent that the skirt 42 snaps inwardly after the ledge 44 clears the lip 30, and in so doing, the ledge 44 becomes engaged with the lip 30. In the event that engagement of the seal portion 32 with spout 20 does occur, it can be easily disengaged by lifting tab 38 (shown in FIGS. 1 and 4) and rotating the seal portion away from the opening to gain access to the can contents.

After dispensing a portion of the can contents, resealing of the can is readily accomplished by repositioning the seal portion 32 in an overlaying position over spout 20 and applying a downward pressure substantially uniformly across the top of the seal portion 32 to effect engagement with the spout 20. Engagement may be made with the greatest ease and least required force by applying downward pressure at a point or relatively small area adjacent the edge of the seal portion so as to concentrate the force necessary to spring only a relatively small segment of the skirt 42 outwardly and downwardly a distance for the ledge 44 to clear the spout lip 30. Assuming a thumb is used to apply the force, the thumb is then rolled and/or moved progressively around the circumference of the cap until engagement is completed.

Figure 15:
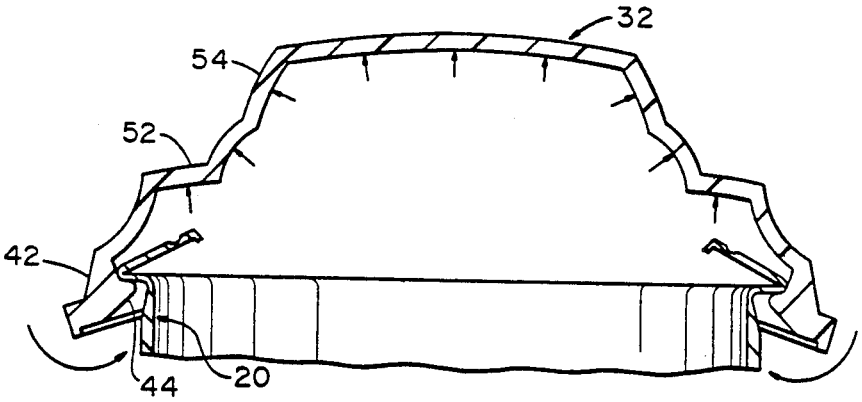
FIG. 15 is a cross-sectional view of the seal portion and can shown in FIG. 14 with the can having internal pressure therein sufficient to effect a high pressure seal between the cap and can and to bulge the cap top wall.

The downward angle of inclination of the engaging ledge 44 is important for several reasons. In determining the optimal downward angle of inclination, consideration must be given to the effect of such angle on sealing characteristics of the cap, ease of disengagement of the cap from the spout, and the preferred method of molding the cap. It may be seen that when the seal portion 32 is engaged with the spout 20, as shown in FIG. 15, entrapped gases within the can exert a force against the exposed surfaces and the engagement of the seal portion with the spout must be sufficient to resist this internal pressure. From the standpoint of insuring that the cap not be blown off the spout by such gases, it would be desirable that the ledge have no downward angle of inclination from horizontal or that such downward angle be minimal. Such an angle is not desirable, however, with respect to providing for ease in disengaging the cap from the spout or with respect to the preferred method of molding the cap. To disengage the sealing portion of the cap from the spout, tab 38 (not shown in FIG. 9) is grasped and lifted. Such lifting causes ledge 44 to slide along the bottom surface of spout lip 30 adjacent the line of connection between the tab and the seal portion 32. As lifting of tab 38 is continued, the ledge 44 is progressively disengaged from the spout 30. The greater the downward angle of inclination from horizontal of ledge 44, the less the force required to disengage the sealing portion from the spout and, therefore, the greater the ease in effecting disengagement.

For ease and economy of molding cap 10, it is also desirable to maximize the downward angle of inclination of ledge 44. It is preferable to mold a cap of this preferred embodiment with a mold referred to as a stripping mold. Such a mold includes two portions—a female portion which is contoured to form all of the upper and exterior side surfaces of the cap, and a male portion which is contoured to form all of the interior surfaces of the seal portion 32 and underlying surfaces of tab 38. In molding the cap, the two mold portions are brought together and thereby define a cavity in the shape of the cap. After the mold is filled with plastic and the cap is formed, the female mold portion is separated from the cap and the cap remains engaged with the male portion by the ledge 44. The lesser the downward angle of inclination of ledge 44, the greater is the difficulty in stripping the cap from the mold without tearing at the base of the ledge. The optimal angle of inclination on the ledge 44, therefore, is one which is suitable for making the cap 10 in a stripping mold, which will provide sufficient holding and sealing power when the seal portion 32 is engaged with the spout to retain it in engagement, and which will enable the cap to be disengaged with minimal applied force. As will now be explained, the maximum downward angle of inclination from horizontal of the ledge 44 on the cap as molded is controlled by the coefficient of friction between the engaging surfaces of the ledge 44 and the spout 20.

Figure 10:
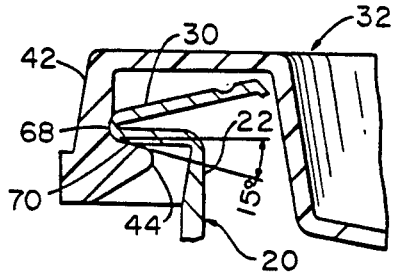
FIG. 10 is a cross-sectional view of a portion of a seal portion of a cap of this invention in sealing engagement with a lip portion around an opening in a can.

In this preferred embodiment, the cap 10 is molded from low density polyethylene and the can end 12 is fabricated from aluminum alloy 5182-H19 produced by Alcoa with an applied organic coating suitable for contacting a carbonated beverage. Other aluminum alloys may also be used in making the can end. The coefficient of friction between the above two materials is 0.36 and an angle having a tangent equal to 0.36 is 20°. FIG. 10 illustrates features of the present invention which are important in providing a substantially gas-tight and liquid-tight seal. High pressure sealing engagement of the seal portion 32 with the spout 20 is dependent upon contact between the ledge 44 and the spout lip 30 at seal zone 70, and low pressure sealing is provided by hoop tension in the skirt 42 compressing an interior portion of the skirt against the spout lip 30 in an initial seal zone 68. The underside of lip 30 projects outwardly from the spout sidewall 22 at a substantially 90° angle and the ledge 44 is inclined downward at an angle of 15° from horizontal. Although an angle of 20° is satisfactory to prevent blow-off, this preferred embodiment is molded with a 15° downwardly inclined ledge angle to provide a safety factor of 5° rotational elastic deflection before any unbalanced disengaging force arises. It is also noted that with the ledge inclined at 15° the cap can be readily made in a stripping mold. Contact between the ledge 44 and the lip 30 occurs along a line or narrow zone of tangency 70 which provides a seal zone against the ultimate high pressures which may develop in the container. Providing such initial low pressure and high pressure seal zones is important to insure that a substantially gas-tight and liquid-tight seal of a carbonated beverage is attained. The skirt 42 has an inside diameter slightly less than the outside diameter of the spout lip 30 in order to compress the skirt in the initial seal zone 68.

After initial engagement of sealing portion 32 with the spout 20, escaping gas dissociating from the carbonated beverage causes pressure within the can to steadily increase. Such pressure is first resisted by hoop tension in the skirt 42 which causes the skirt to compress against the lip 30 in the initial seal zone 68. It is not essential that the seal in the initial seal zone be absolute. It is important, however, if gas does escape through the initial seal zone, that the seal be sufficient to ensure that the escape of gas is at a slower rate than it dissociates from the beverage so that pressure can build in the container to effect a high pressure seal. As internal pressure increases due to the initial seal, such pressure operates against the interior of the seal portion 32 to lift it from the spout. Thus, the ledge 44 becomes pressed more tightly against the spout lip in the high pressure seal zone 70 as the interior pressure increases. At a pressure of about 15 psi, contact between the ledge and spout lip is sufficiently tight to insure a substantially gas-tight seal, and the initial seal is no longer required. By providing the high pressure seal zone 70 independent of the initial seal zone 68, the skirt 42 can be adapted to require a minimal amount of compression for a low pressure seal which is advantageous in making the seal portion relatively easy to engage and disengage from the spout. It has also been found that a lubricant in the initial seal zone improves the initial seal. A suitable lubricant, such as paraffin wax, may be applied by dipping the cap in a wax bath. Alternatively, the lubricant can be added to the molding compound prior to molding, in which case the lubricant blooms to the surface after molding.

Figure 11:
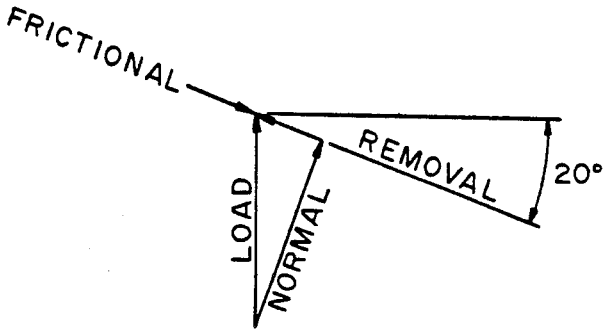
FIGS. 11, 12 and 13 are vector diagrams of the forces acting along the line of engagement between a seal portion of a cap of this invention and a lip around an opening in the can with the engaging ledge of the seal portion inclined outwardly and downwardly from horizontal at angles of 20°, 15° and 30°, respectively.
Figure 12:
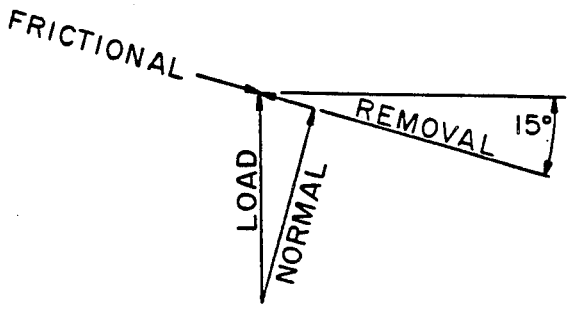
Figure 13:
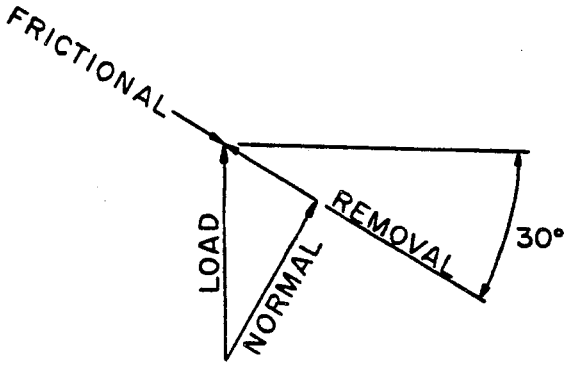

The importance of the downward inclination of the ledge 44 with respect to horizontal may be seen with reference to the vector drawings shown in FIGS. 11, 12 and 13 which show force vectors acting on seal portion 32 and lip 30 surfaces, as shown in FIG. 10, in the high pressure seal zone 70 with the ledge 44 at varying downward angles of inclination with respect to horizontal. In each of FIGS. 11, 12 and 13, the vector notations have the following meanings: "Load" represents the force applied by the ledge 44 against the spout lip 30 as a result of internal pressure. "Normal" represents the component of the Load force acting normal to the ledge. "Removal" represents the component of the Load force acting parallel with the surface of the ledge and urging disengagement of the ledge from the lip. "Frictional" represents the force acting in opposition to the removal force and is the product of the coefficient of friction between the lip and ledge materials and the Normal force.

In FIG. 11, the vectors are shown as applied to ledge 44 inclined downward at an angle of 20° with respect to horizontal in assembly with spout lip 30. At 20°, which is the angle having a tangent equal in value to the coefficient of friction between the spout lip 30 and ledge 44 of 0.36, the Removal force is equal to the Frictional force. The frictional force, therefore, is sufficient to prevent the ledge from disengaging from the spout.

In FIG. 12, the vectors are shown as applied to a ledge 44 having a downward angle of inclination from horizontal of 15°, which angle has a tangent of 0.27. The Removal vector is less than the Frictional vector, and the ledge, therefore, can undergo 5° of rotational elastic deflection under load and the frictional force will still be sufficient to prevent the ledge from disengaging from the spout.

In FIG. 13, the vectors are shown as applied to a ledge having a downward angle of inclination with respect to horizontal of 30°, which angle has a tangent of 0.58. The Removal vector is greater than the Frictional vector and, thus, the frictional force is not sufficient to prevent disengagement of the ledge from the spout. It is noted that when the frictional force is not sufficient to prevent disengagement such as shown in FIG. 13, disengagement of the cap from the spout might be prevented by increasing the hoop strength in the cap skirt. Increasing the hoop strength, however, necessitates increasing the stiffness of the skirt and, even if it were possible to develop sufficient hoop strength to prevent disengagement, greater force would be required to engage or disengage the cap with the spout.

Thus, if the tangent of the downward angle of inclination from horizontal of the ledge is equal to or less than the coefficient of friction between the ledge and spout lip materials, the frictional force alone will retain the ledge in engagement with the spout lip. Utilization of frictional force alone to maintain the cap in engagement with the container permits the hoop tensile stiffness of the skirt to be no greater than that necessary to provide a low pressure seal and the cap can be easily engaged and disengaged with the container.

Figure 14:
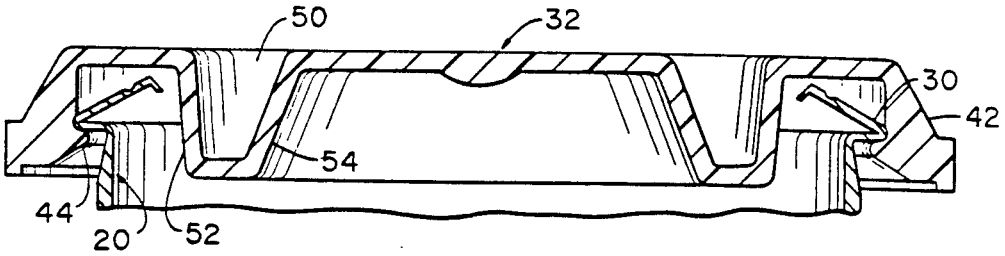
FIG. 14 is a cross-sectional view of a sealing portion of a cap of this invention engaged with a can having no internal pressure therein.

In order to maximize the utilization of frictional force between the cap ledge and spout lip to maintain a cap of this invention in engagement with the container, the seal portion 32 of a cap of this invention is adapted to bulge substantially outwardly as internal pressure increases. As will now be discussed, such bulging causes the angle of inclination of the ledge from horizontal to decrease as the pressure increases and, thus, utilization of frictional force is maximized. Referring first to FIG. 14, the seal portion 32 is shown as applied to the spout 20 before internal pressure in the container begins to increase from dissociating gas. As has previously been discussed, the inside diameter of the skirt 42 is sized to be less than the outside diameter of the spout lip 30 an amount sufficient to generate an interference fit and sufficient hoop tension in the skirt to effect an initial seal. As gases dissociate from the beverage, top wall portions of the seal portion 32 begin to bulge upwardly, as shown in FIG. 15, from increasing internal pressure until the maximum effect from the pressure is realized by causing the walls 52, 54 defining the groove 50 to spread and thereby at least partially flatten the wall structure defining the groove. As a result of such bulging, skirt 42 and ledge 44 rotate inwardly, as indicated by the arrow, decreasing the angle of inclination from horizontal and maximizing the utilization of the frictional force in preventing blow-off of the cap.

Figure 36:
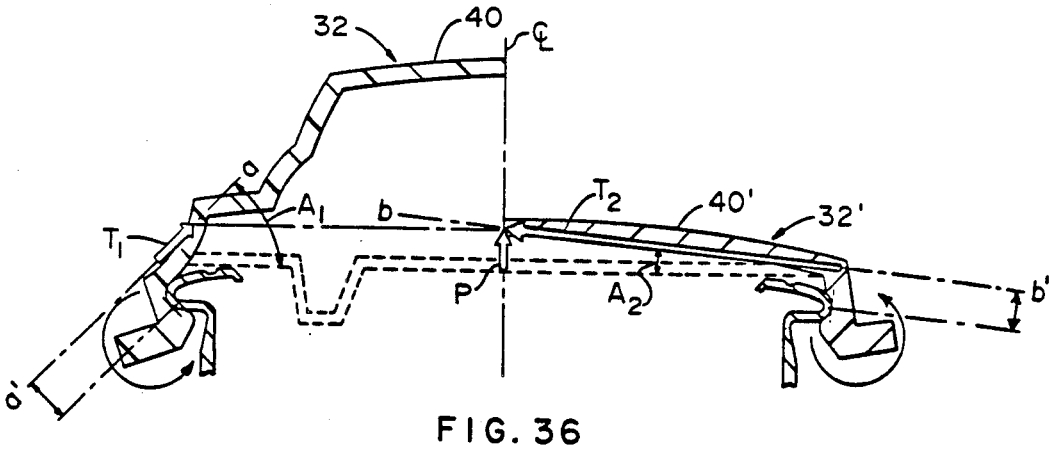
FIG. 36, to the left of the centerline, is a cross-sectional view having force vectors imposed thereon of the sealing portion of a cap of this invention having a top wall adapted to substantially bulge from internal pressure in sealing engagement with a can having internal pressure therein and, to the right of the centerline, a cross-sectional view having vectors imposed thereon of a cap of this invention having a substantially flat top wall which does not substantially bulge from internal pressure in sealing engagement with a can having internal pressure thereon.

Although not intending to be bound by any theory, it is believed that a cap of this invention having a top wall adapted to substantially bulge under pressure has improved resistance to blow-off as compared to a cap having a substantially flat wall for reasons which follow. Referring to FIG. 36, the portion of the figure on the left of the centerline represents a seal portion 32 having a top wall 40 adapted to substantially bulge under pressure when the seal portion is in sealing engagement with a container having internal pressure therein. The portion of the figure on the right of the centerline is a seal portion 32' identical in all respects to seal portion 32 except for having a substantially flat top wall which is not adapted to substantially bulge under pressure. Seal portion 32' is shown in sealing engagement with a container identical to the container shown on the left of the centerline and is subject to the identical pressure as is seal portion 32. Both seal portions 32, 32′ are made from an identical plastic compound having a low modulus of elasticity (approximately 20,000 psi) and the top wall 40, 40′ of each is relatively thin (approximately 0.020 inch). Although the top walls of each are thin, the walls are of sufficient thickness to withstand anticipated internal pressures without developing unit stresses in excess of the elastic limit of the plastic from which they are made. Referring first to the portion of the figure to the right of the centerline, vector P represents the vertical component of the total force acting against top wall 40′ from the internal pressure within the container. Although the pressure acts uniformly across the surface of the top wall, vector P is shown as a single line acting at the center of the wall for convenience of discussion. The horizontal component of the force is not shown since such component has a relatively small value and has practically no effect on the blow-off resistance of the cap. Since the top wall 40′ is relatively thin and has a low modulus of elasticity, it has low bending stiffness and primarily resists the force of vector P in tension. It also bulges upwardly from its unpressurized position shown as dashed lines to assume a slightly arcuate domed position. Although the tension force resisting the force of vector P acts through the slightly arcuate top wall, it is shown as a straight line vector $T_2$ acting along approximate centerline b—b′ for convenience, and such showing can be made without introducing any appreciable error. As internal pressure increases, P and $T_2$ likewise increase until the highest anticipated internal pressure is reached. At such highest anticipated internal pressure, top wall 40′ and vector $T_2$ will have rotated through angle $A_2$ and, according to principles of static equilibrium, $T_2$ will have a magnitude which will provide a vertical component equal to P. It is evident that a substantially flat top wall, such as top wall 40′, will rotate through a relatively small angle $A_2$ from the application of internal pressure, and as a consequence, the tension $T_2$ in the top wall will be relatively large.

Figure 37:
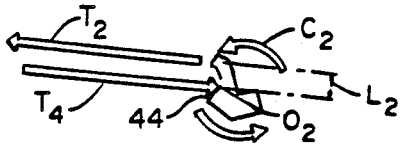
FIG. 37 is a free body view having force vectors imposed thereon of the skirt portion of the sealing portion on the right of the centerline in FIG. 36.

In contrast, the seal portion 32 to the left of the centerline in FIG. 36 will substantially bulge under the identical highest anticipated pressure and will rotate from the position shown in dashed lines through a relatively large angle $A_1$ before reaching a position of static equilibrium. Because angle $A_1$ is substantially larger than angle $A_2$, tension force $T_1$ in top wall 40 acting along approximate centerline a—a′ is substantially less than tension force $T_2$ in top wall 40′. The effect of the relatively large differences in magnitude between $T_1$ and $T_2$ and angles $A_1$ and $A_2$ with respect to blow-off resistance may be seen with reference to FIGS. 37 and 38. FIG. 37 shows the skirt portion of the seal portion shown on the right-hand side of the centerline of FIG. 36 as a free body and the forces acting upon it. The tension force $T_2$ is resisted by a force $T_4$ of equal magnitude and acting parallel to $T_2$ at point $O_2$ which is the point of tangency between the ledge 44 and spout lip 30. Tension force $T_2$ acting in a plane spaced away from point $O_2$ by the distance $L_2$ produces a force couple $C_2$ acting in a counterclockwise direction and having a magnitude determined by multiplying the amount of force $T_2$ by the length of moment arm $L_2$. The effect of force couple $C_2$ is to tend to rotate the ledge in a counterclockwise rotation increasing its angle of inclination with respect to horizontal and thereby decreasing it resistance to blow-off. The slight doming or bulging of the top wall tends to rotate the ledge in a clockwise direction to offset the counterclockwise rotation caused by the couple $C_2$. The clockwise direction rotation, however, is a function of the vertical component of the internal pressure acting on top wall 40′ that has rotated through the angle $A_2$ and, because of the relatively small value of angle $A_2$, there is negligible resistance to counterclockwise rotation of the ledge.

Figure 38:
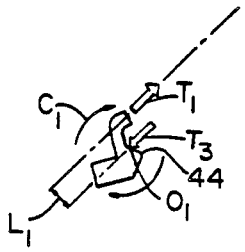
FIG. 38 is a free body view having force vectors imposed thereon of the skirt portion of the sealing portion on the left of the centerline in FIG. 36.

Referring now to FIG. 38 which is the skirt portion of the seal portion to the left of the centerline in FIG. 36 shown as a free body, tension force $T_1$ is resisted by opposite force $T_3$ of identical magnitude acting at point $O_1$. The plane of action of force $T_1$ is offset from point $O_1$ a distance $L_1$ which is equal to the offset distance $L_2$ for the seal portion to the right of the centerline. A force couple $C_1$ rotating in a clockwise direction equal in magnitude to the product of $T_1$ and length $L_1$ is generated by forces $T_1$ and $T_3$. Since $T_1$ is substantially smaller than $T_2$, force couple $C_1$ is shown with substantially thinner lines than the couple $C_2$ to indicate the relative difference in magnitude between the two. In the case of the cap seal portion 32 shown on the left of the centerline, force couple $C_1$ acts to tend to rotate ledge 44 clockwise so as to increase the angle of inclination with horizontal and thereby decrease its resistance to blow-off just as force couple $C_2$ does on seal portion 32′. Such tendency to rotate clockwise is offset, however, by the vertical component of the total force of the internal pressure acting against top wall 40 which is rotated through angle $A_1$. It may be seen that if the bulging of top wall 40 is sufficient, the tendency for counterclockwise rotation of ledge 44 will be greater than the tendency for clockwise rotation and the ledge will be rotated counterclockwise and increased resistance to blow-off will be provided thereby. From the foregoing, it may be seen that as the ability to bulge under pressure of the top wall of a seal portion of a cap of this invention increases, the greater is the force acting on the skirt to rotate the ledge inwardly and the less is the magnitude of the force couple tending to rotate the ledge outwardly with the net effect being to improve the blow-off resistance of the cap. Thus, providing sufficient bulging of the top wall of a cap of this invention enhances the maintenance of a high pressure seal of the gas within the container. It is evident, however, that a cap having a particular top wall thickness and skirt and ledge structure will ultimately blow off at some internal pressure. As the internal pressure increases and the top wall becomes bulged to its limit within the elastic limit of the plastic material, the tension force $T_1$ increases as well. The angle $A_1$ remains unchanged with increasing pressure after the top wall has reached its bulging limit, but the lifting force working through the skirt wall steadily increases and finally becomes so great as to cause bending or deformation of the skirt and ledge structure in the area of their juncture. As a consequence, the angle of inclination of the ledge with horizontal is increased, and when it exceeds an angle having a tangent equal to the coefficient of friction between the ledge and container lip materials, the cap will disengage from the container lip and blow off. As has been noted earlier, a cap capable of sealing at pressures up to 50 psi will usually be satisfactory for sealing carbonated beverages. Some beverages, however, may develop internal pressures up to 100 psi, in which case it may become necessary to strengthen the skirt and ledge junction to function satisfactorily at such higher pressure. In general, it is preferred to make the skirt and ledge structure no stronger or rigid than necessary to withstand the anticipated internal pressure for ease in engaging and disengaging the cap with the container lip. Making the top wall portions of the seal portion 32 sufficiently thin to bulge under pressure also provides the added advantage of minimizing the amount of material required to make the cap and provides readily visible evidence of a satisfactory seal of the container. A further advantage is that the cap can be molded with the ledge 44 having an optimal downward angle of inclination for molding purposes since the angle decreases from the effect of internal pressure. After seal portion 32 is disengaged, the top wall 24 will typically again assume its as-molded shape, although temperature, amount of pressure and the length of time the seal portion is subject to the pressure will affect the recovery to its original shape. If, for example, the seal portion were engaged with a container having a relatively high internal pressure for an extended period of time at a relatively high temperature, the seal portion might not return to its original shape after disengagement without additional manipulation by hand to promote its return.

Figure 16:
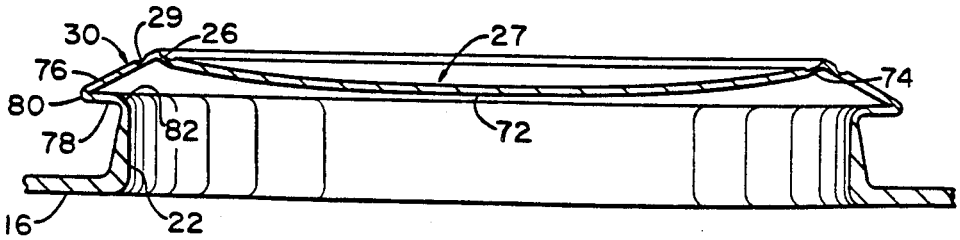
FIG. 16 is a cross-sectional view of a spout projecting outwardly from a can end to be opened and sealed with a cap of this invention.

Certain features of the spout 20 of a preferred embodiment of a can end for use with a cap of this invention are important and will now be discussed with reference to FIG. 16. The spout opening panel 27 is inwardly concave and includes a central portion 72 and a ring portion 74 of a thinner thickness extending therefrom. The preferred line of weakness 26 is made by scoring in a manner described in Jordan U.S. Pat. No. 3,997,076 which is hereby incorporated by reference. The concave opening panel combined with such a score line is preferred because internal pressure within the can acting against the concave panel puts the metal in the line of weakness 26 in compression which provides maximal resistance to rupture from internal pressure, but the score line can be easily ruptured by the application of an external force adjacent thereto to gain access to the container content. The spout lip 30 is comprised of a top wall 76 extending from the scored line 26 at a slightly downward angle from horizontal (approximately 15°–25°) and is connected with a substantially horizontal bottom wall 78 underlying the top wall by an arcuate outer wall 80. Anti-fracture score 29 is a coined zone adjacent the line of weakening 26 which is provided to control stresses produced in forming the line of weakening. The spout sidewall 22 projecting upwardly from the end wall 16 of the can end is connected to the bottom wall 78 of the lip by a second arcuate portion 82. It is noted that the wall thicknesses of the lip portions 76, 78 and 80 and the second arcuate portion 82 are reduced in thickness relative to the thickness of the can end wall and the thickness of the spout sidewall. The relatively thin wall is desirable for the purpose of forming the arcuate connecting walls 80 and 82 with a minimal radius. Locating the point of transition from the relatively thicker sidewall 22 to the thinner arcuate portion 82 just below arcuate portion 82 controls the location of and assists in minimizing the radius of arcuate portion 82. Controlling the thickness, length and locations of bottom wall 78 and of arcuate portions 80 and 82 is desirable to insure that lower wall 78 of lip 30 projects outwardly from spout sidewall 22 at a substantially 90° angle, as will be discussed later.

Lip 30 is adapted to maximize the sealing performance provided by the seal portion. The arcuate portion 80 is provided with a minimal radius to take advantage of the smooth surface of the sheet for the sealing surface and also to minimize the area of sealing contact so as to maximize the unit pressure in the seal area. Maximizing the unit pressure in the initial seal area by providing a minimal radius on the lip is important so that the degree of interference fit between the cap and the lip can be minimized. The less the interference fit required to attain an effective initial seal, the greater the ease in applying and removing the cap from the spout. By thinning the metal to form the lip, the radius of the arcuate portion 80 can be minimized and unit pressure in the seal zone can be maximized and thereby attain enhanced seal security. The arcuate portion 80 presents a substantially smooth surface for the plastic cap surfaces to slide against during application and removal with no degradation of the seal quality or blowoff resistance. The plastic sealing surfaces are therefore not cut, scraped or otherwise damaged during application and removal. This is in contrast to some of the prior teachings noted heretofore which describe sealing against sheared edges, or edges of a fractured score. Sealing against such edges will produce high unit pressure in the seal area because of low contact area, but such edges are very sharp and may cut or scrape the plastic sealing surfaces and thus degrade seal quality.

Thinning the metal to reduce the size of the seal radius has the further advantage of decreasing the required inward extent of cap ledge 44 to insure that seal portion 32 engages with the spout lip 30 and that the high pressure sealing zone 70 is positioned on the downwardly inclined portion of ledge 44. The larger the radius of arcuate section 80, the greater is the required inward extent of ledge 44 to effect engagement. As the required inward extent of the ledge increases, the greater the difficulty of applying and removing the snap cap with no improvement in seal performance or blowoff resistance.

Thinning the metal in arcuate portion 82 and terminating the thinned section just below arcuate portion 82 reduces the size of the radius required for forming and causes arcuate section 82 to occur just above the unreduced section. This combination, along with control of the thickness, length and location of underside wall 78 and arcuate portion 80, causes underside wall 78 of the lip to form at a substantially 90° angle to sidewall 22 of the spout. Use of a controlled amount and location of thinning is important to control the shape of the lip during forming, as will be discussed later.

Figure 19:
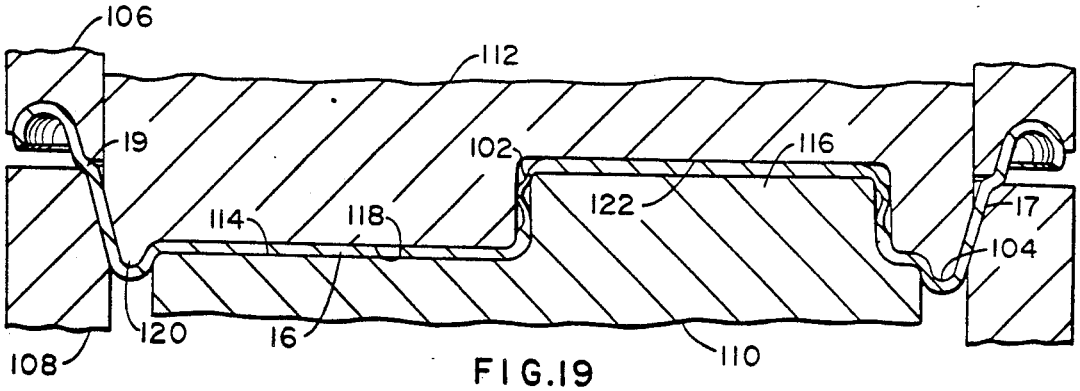
FIG. 19 is a cross-sectional view of the reformed blank shown in FIG. 18 and forming dies at the completion of a second reforming step to reform the reformed bubble shown in FIG. 18.
Figure 20:
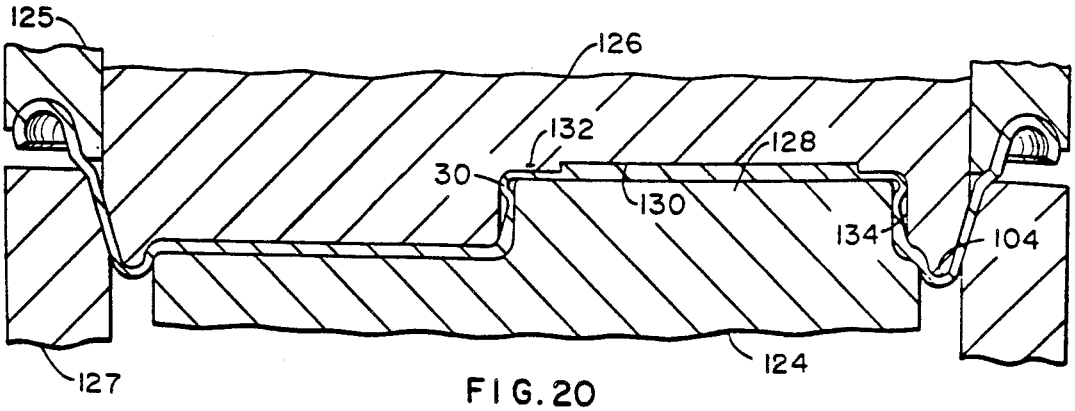
FIG. 20 is a cross-sectional view of the reformed blank shown in FIG. 19 and forming dies at the completion of a third reforming step to further reform the reformed bubble shown in FIG. 19.
Figure 21:
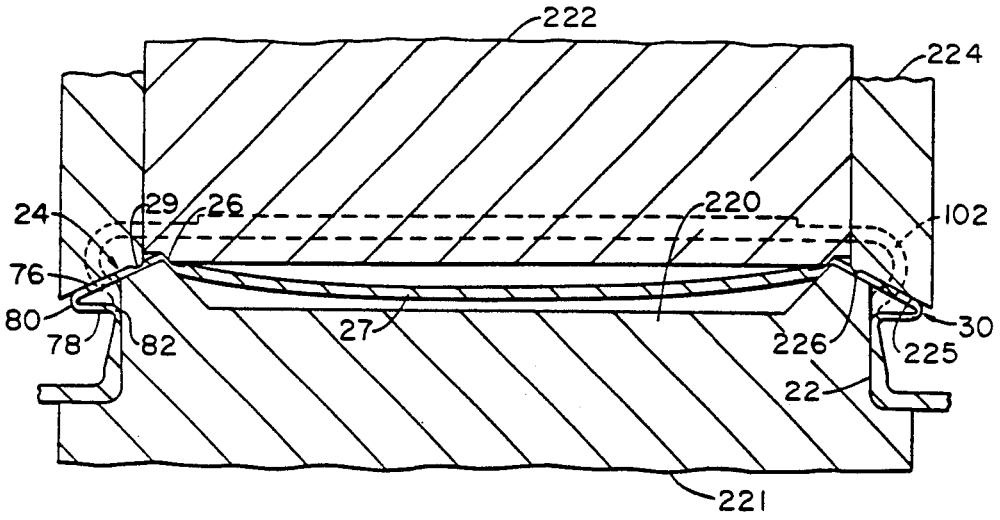
FIG. 21 is a cross-sectional view of the reformed blank shown in FIG. 20 and forming dies at the completion of the final step in forming the spout and scoring the top wall of the spout shown in FIG. 16.

The spout 20 is formed in five stages: the first four as shown in FIGS. 17, 18, 19, and 20 form the spout to a desired height and diameter and partially form the spout lip, and then a final stage as shown in FIG. 21 finishes forming the lip and scoring the spout end wall 24 by using the method described in previously incorporated by reference U.S. Pat. No. 3,997,076. Forming of the can end will be described with reference to making a 209 can end, a typical size for packaging carbonated beverages, but the method of forming hereafter described is not limited to any particular size of can end.

Figure 17:
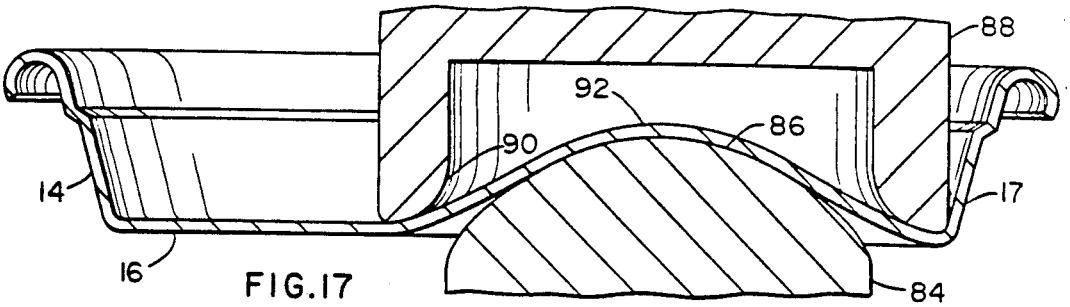
FIG. 17 is a cross-sectional view of a can end blank and forming dies at the completion of the first step in forming the spout shown in FIG. 16.

In a first forming stage shown in FIG. 17, a can end blank 14, as shown in FIG. 3, of a preferred aluminum alloy 5182-H19 produced by Alcoa and having a nominal thickness of 0.0115 inch is inserted into a press between spaced apart forming dies which are in coaxial alignment and at least one die is adapted for coaxial movement relative to the other. A first die 84 has a dome-shaped forming surface 86, and the opposing second die 88 has an annular arcuate forming surface 90. Die or dies 84, 88 are moved relative to one another to a closed position, as shown in FIG. 17, to form the metal in the end wall 16 into an initial bubble 92.

The location of the initial bubble 92 in this first forming step is important in making this preferred embodiment. A relatively large amount of metal is required to form the finished spout, so it is desirable to form the largest bubble possible consistent with the final dimensions of the can end closure.

For ease of pouring or drinking beverage from the container, it is also desirable that the spout have as large an opening as possible and that the spout, as finally formed, be positioned as closely as possible to the edge of the can. By reference to FIGS. 1 and 2, it may be seen that the spout and the seal portion 32 of the cap 10 fit side by side on the panel end wall 16 and thus the sum of the spout diameter and the outermost diameter of the seal portion 32 plus the extent of the tab 38 must be less than the diameter of the end wall 16. In addition, clearance between the spout and the sidewall 17 of the can end panel 14 must be provided to accommodate a chuck that is used in double seaming the can end to the can. For a 209 can, it has been determined that the distance from the axis of the can end blank 14 to the center line of the bubble 92 should be at least 0.529 inch, and using the aforesaid parameters to locate the bubble 92 on the can end 16, the bubble is formed as shown in FIG. 17 as high as possible and as close as possible to the upwardly flaring can end blank sidewall 17.

Figure 18:
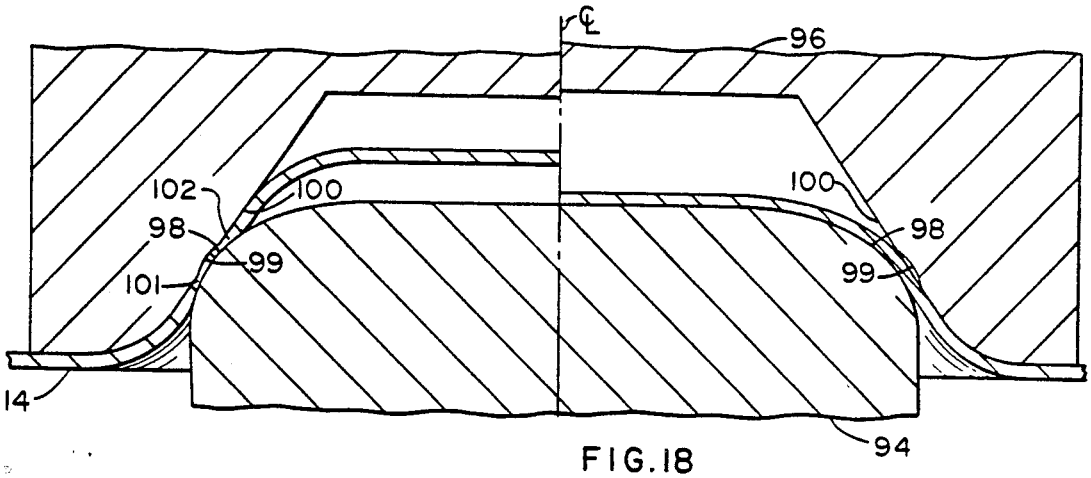
FIG. 18 is a cross-sectional view of the bubble portion of the formed blank shown in FIG. 17 and forming dies at the completion of a first reforming step to reform the bubble.

During the second forming stage, as shown in FIG. 18, the can end blank 14 having the bubble 92 thereon is further formed to add additional height to the bubble and reform the bubble to a shape intermediate the final spout shape. The blank 14, as formed in FIG. 17, is inserted into a forming press between a second pair of coaxially aligned spaced apart forming dies 94, 96 with at least one die adapted for axial movement relative to the other. To the right of the centerline in FIG. 18, dies 94 and 96 are shown in the initial forming position, die 94 having moved relative to the bubble 92 shown in FIG. 17 to reform the bubble. Dies 94 and 96 are then moved relative to each other squeezing can end wall material between them to coin a portion thereof and further reform the bubble as shown to the left of the centerline. The male die 94 has an arcuate forming surface 98 to stretch the bubble during the initial interaction between the forming dies to a shape conforming to the male die forming surface. The female die 96 has a frustoconical forming surface 100 to interact with the male die 94 to coin a portion of the reformed bubble and increase its height. A slight depression 99 is provided in the frustoconical forming surface of die 96 to prevent excessive thinning of a zone which will later be formed into the bottom wall 78 of the lip 30 as shown in FIG. 16.

Referring now to the left side of the centerline in FIG. 18, dies 94 and 96 are shown at the completion of their relative movement with respect to each other. It may be seen that as can end wall material is compressed between the arcuate forming surface 98 of die 94 and the frustoconical forming surface 100 of die 96, the depression 99 fills with end wall metal, and metal adjacent to the depression is coined. The coined metal 101 below the depression will later be formed into the second arcuate lip portion 82 (FIG. 16) and the coined metal 102 above the depression will be formed into the first arcuate lip portion 80 (FIG. 16). The proper positioning of the coined metal in this area is important in attaining the final shape of the spout lip later. Metal that is displaced in the coined area 102 is extruded upwardly causing the reformed bubble 92 of FIG. 17 to be raised from the surface of die 94 and increase the height of the intermediate formed spout. The coined metal 102 produced in this second forming stage has controlled zones of thickness varying from approximately 0.0050 to 0.0055 inch and its proper positioning and length is important to provide coined metal which will subsequently be formed into the spout lip. Coining further contributes to increasing the height of the intermediate spout shape. It is preferable that the coining be accomplished with the female die 96 because it is important that die 94 have a precise contour and smooth forming surface to accomplish the desired amount of stretching that occurs before coining without causing tensile fracture of the bubble. It is also preferable to coin with the female die 96 to avoid the possibility of damage to the organic coating which is present on the interior surface of the end wall 16 of the blank.

The third forming stage, as shown in FIG. 19, further reforms the spout to its final outside diameter, exclusive of the lip which is formed later. In addition, an annular groove 104 is formed at the junction of the can end wall 16 with the sidewall 17. Can ends typically include such an annular groove to increase the resistance of the end against buckling from internal pressure. In the usual practice of making a can end, the groove is formed concurrently with forming the end blank from a sheet blank. In making a can end of this invention, however, it is preferable to delay forming the groove until this or a subsequent stage in order that the spout can be located as close as possible to the chime on the finished can. As has been noted heretofore, it is desirable to form the initial bubble as large as possible, and forming the bubble and spout before forming the groove permits gathering metal from the area to be occupied by the groove to form the bubble as closely as possible to the sidewall 17 of the can end and thereby position the spout as closely as possible to the can chime.

At the beginning of the third stage in forming the spout, the formed blank as shown on the left side of centerline in FIG. 18 is inserted into a press between upper and lower support rings 106, 108 which pinch outwardly projecting step 19 therebetween. Coaxially aligned, spaced apart dies 110, 112, with at least one die adapted for axial movement relative to the other, are then brought together. The male die 110 has a substantially planar forming surface 114 and a substantially cylindrical projection 116, projecting upward therefrom to assist in forming the interior of the spout to its finished inside dimensions. The female die 112 has a substantially planar forming surface 118, an annular ridge 120 for forming groove 104 to an inside radius of approximately 0.030 inch, and a cylindrical recess 122 to cooperate with the male die features in forming the can end having a spout therein. FIG. 19 shows dies 110, 112 in a closed position at the end of this third forming stage. It is noted that during this forming stage the reformed bubble is substantially flattened with the coined metal zone 102 positioned so as to be subsequently formed into the spout lip.

The fourth stage in forming the spout, as shown in FIG. 20, partially forms the outwardly projecting lip 30 around the periphery of the spout. The formed can end blank, as shown in FIG. 19, is inserted between coaxially aligned spaced apart ring dies 125, 127 which are adapted to hold the formed can end between the dies in the flange area. Central die portions 124, 126 are shown in a closed position and are adapted for vertical movement relative to one another. The male die 124 functions as a support tool having a cylindrical support portion 128 projecting upwardly from the die face. Female die 126 includes a cylindrical recess 130 having a cylindrical side surface 134 with an inside diameter slightly greater than the spout diameter in order to partially form the lip. A coining ring 132 extends inwardly from the cylindrical side surface 134. This ring coins the metal in the spout end wall and extrudes metal radially outwardly from the spout to partially form the lip 30. FIG. 20 shows the dies 124, 126 in a closed position after this partial lip-forming stage has been completed. As the dies 124, 126 come together, the coining ring 132 contacts the end wall of the flattened bubble to reduce the metal thickness in the coined area to a thickness of approximately 0.007 inch and extrude metal radially outwardly and thereby partially form lip 30. In this, the fourth stage of forming the spout, the annular groove 104 which was formed in the third stage is reformed to a smaller radius of approximately 0.016 inch. The groove was not formed to this smaller radius in one step to reduce the danger of fracturing the metal in the groove area if a single forming step was used. The smaller radius is advantageous because a thicker gauge of metal would be required to resist buckling from equivalent internal pressure if the groove were not reformed to the smaller radius.

Figure 22:
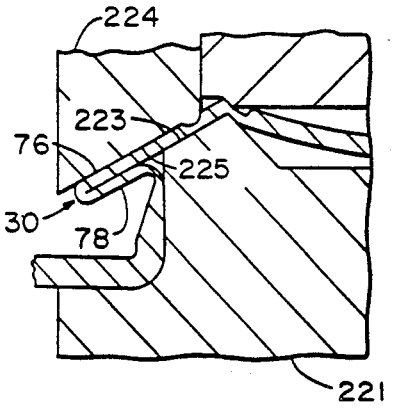
FIG. 22 is a fragmentary cross-sectional view of forming dies and an alternate embodiment of the lip portion of the spout shown in FIG. 21.

FIG. 21 illustrates the fifth stage of forming the spout which forms the lip to its final shape and dimension and scores the end wall. It also illustrates the advantage of reducing the thickness of the metal in the lip as much as is practically possible. The spout, before forming, is shown in dashed lines and, as has previously been noted in discussing the second forming stage, the coined metal 102 has controlled zones of varying thicknesses to enable forming the lip 30. The metal in area 102 which is formed into arcuate sections 80 and 82 is thinner than the metal which is formed into relatively straight sections 76 and 78 and that which is to be formed into arcuate section 80 is thinner than that to be formed into arcuate section 82 to insure that a desired small radius is formed at 80. To finish forming the spout and score the spout end wall, the can end blank as formed in the fourth forming stage is positioned on a support die 221 having an upwardly extending portion 220 with a diameter suitable to fit within the spout. As shown by dashed lines, the upper portion of the partially formed spout extends above the upwardly extending portion 220 of the support die. The upper die is comprised of a central cylinder 222 and circumscribing ring 224. The dies in FIG. 21 are shown in a closed position, but at the beginning of this final forming stage, dies 222 and 224 are in a raised position spaced apart from the can end blank. Opposing faces of die 222 and the upstanding portion 220 of the support die are contoured to form the score line 26 and form the opening panel 27 with a controlled degree of inward concavity. The outer ring die 224 has a die face 225 sloping downwardly and outwardly to form the upper spout lip wall 76 downwardly. At the inner edge of the outer ring die face, an annular bead 226 projects outwardly from the die face to form the anti-fracture score 29 in the spout top wall 24. Dies 222 and 224 function as a single unit but are made as separate elements so that the opening score and anti-fracture score can be set up separately and for convenience in making and maintaining the dies. From their raised position, dies 222 and 224 are moved downwardly as a single unit. As the die faces contact the partially formed spout shown as dashed lines, the spout is pressed downward and the partially formed lip portion begins to bend at desired sites for proper forming of the lip. As previously noted, the metal in area 102 is thinner than spout wall 22 and that which forms arcuate sections 80, 82 is thinner than that which forms straight section 78 to insure that the metal bends at desired points. Furthermore, the metal which forms arcuate section 80 is thinner than that which forms section 82 to insure that the desired small radius forms at section 80 before wall section 78 is bent below horizontal. If the metal to form section 82 doesn't have higher bending strength than that which forms section 80, section 82 metal will form preferentially and the section 80 metal will not form to the desired small radius. Since metal will bend where bending strengths are the least, by proper proportioning the thicknesses of the metal and the length of portions having different thicknesses, the lip can be formed to project outwardly at a substantially 90° angle from the spout and with a minimal radius on the arcuate sealing surface. As shown in FIG. 22, a slight modification of support die 221 and ring die 224 enables producing a spout lip 30 having a bottom wall 78 projecting outwardly from the spout at less than a 90° angle. The modification comprises altering the slope of cooperating die faces 223 and 225 so that spout top wall 76 and bottom wall 78 are bent downwardly the desired degree.

Figure 23:
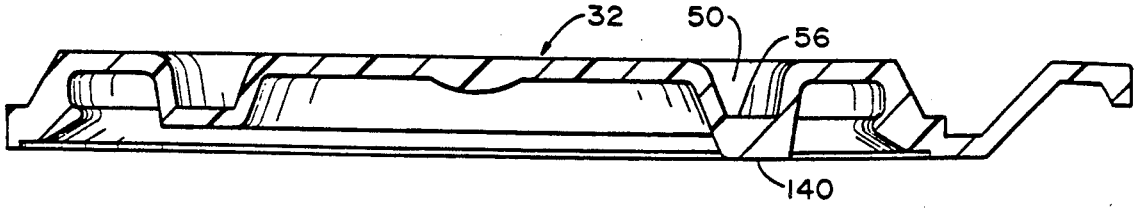
FIG. 23 is a cross-sectional view of an alternate embodiment of the seal portion of a cap of this invention.

In the foregoing description, scoring of the spout end wall is accomplished by use of the method described in U.S. Pat. No. 3,997,076 because such a score line combined with the downwardly concave opening panel minimizes the amount of force required to effect separation of the opening panel from the spout end wall. Other known methods of scoring including providing a score line on either the inner or outer surface of the wall to be scored, for example, may be used in a can end for use with a cap of this invention, although use of such a less preferred score line may require a greater force to effect a separation of the opening panel from the can end. If a score line requiring a greater force to effect separation of the opening panel from the end wall is employed, it may be desirable to provide seal portion 32, as shown in FIG. 23. In this embodiment, a boss 140 is provided which projects downwardly from the seal portion bottom wall 56. The boss may have any suitable cross section, such as cylindrical or triangular, for example, and is preferably located on the bottom wall 56 at a point that is at a minimum of 30° from the unscored hinge 28 when the seal portion 32 is positioned over the spout. Addition of the boss is useful to initiate severance of the opening panel along the score line by providing a concentration of the downward force in the boss area. The seal portion, as shown in cross section in FIG. 23, is identical to that shown in FIGS. 4 and 5 except for the boss 140 and that in FIG. 23 the bottom wall 56 is disposed closer to the top of the seal portion 32 by a distance equal to the thickness of the boss. In use of this just-described alternate embodiment of the seal portion, the cap is attached to the can end wall and the seal portion 32 positioned over the spout as has been described with reference to a preferred embodiment. When downward pressure is applied along the groove 50 above the boss 140 to effect opening of the can, the boss 140 is the first portion of the seal portion to contact the spout opening panel and the downward force is concentrated over the cross-sectional area of the boss to initiate severance of the opening panel. Thereafter, the bottom wall 56 contacts the opening panel adjacent the score line and continued application of pressure ruptures the scored metal causing the opening panel to be bent downward into the can about the opening panel hinge.

Figure 39:
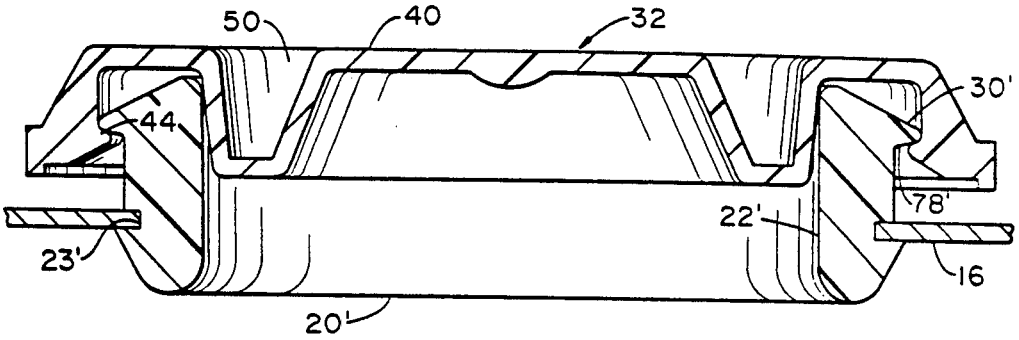
FIG. 39 is a cross-sectional view of an assembly of a cap of this invention with a plastic spout connected with a container end.

Although it is preferred that the spout be integral with the container end, the spout may be made as a separate piece and assembled with the container end. For example, FIG. 39 shows a spout 20' molded of a suitable plastic, such as polypropylene or polyethylene material. The spout is a molded hollow cylindrical tube having a sidewall 22', an outwardly projecting annular lip 30' for engagement with the sealing portion 32 of a cap of this invention, and an annular groove 23' near the bottom end of the sidewall for a snap engagement in an opening in the container end wall 16.

The slope of the underlying surface 78' of the spout lip 30' and the slope of the engaging ledge 44 of the cap seal portion 32 are determined by the coefficient of friction between the plastic cap material and the plastic spout material. The seal portion ledge angle with respect to horizontal when the seal portion is engaged with the spout must not be greater than an angle having a tangent equal to the coefficient of friction between the two materials in order to maintain the cap in sealing engagement. As a consequence, the downward angle of the underlying lip surface 78' with respect to horizontal must also be an angle no greater than an angle having a tangent equal to the coefficient of friction between the sealing portion and spout materials.

In this embodiment, the spout is molded as a hollow cylinder and an end closure must be provided, therefore, when the container is filled. One method of accomplishing an initial seal of the container is to utilize the seal portion 32 by positioning it as shown in FIG. 39 and then apply a rupturable overlay at the junction of the seal portion and the spout. Overlays that might be used, for example, are an adhesive tape or heat shrink plastic collar, either of which could be applied so as to cover the seam between the seal portion and the spout.

If the seal portion 32 were adapted so as to have a flat top wall 40 without the annular groove 50, a heat seal foil disc having sufficient strength and adhesive properties could be applied to the spout opening with the seal portion 32 applied thereover to protect the integrity of the foil disc.

Figure 40:
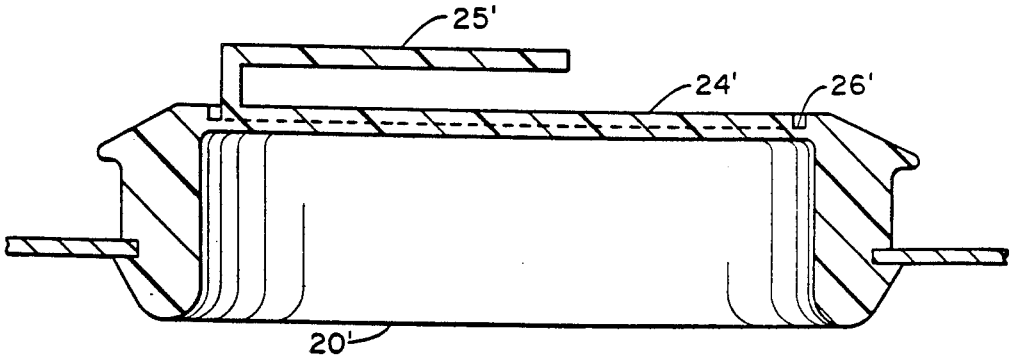
FIG. 40 is a cross-sectional view of a plastic spout having a separable closed end with the spout connected to a container end wall.

In yet another embodiment as shown in FIG. 40, the spout 20' could be molded with a closed end top wall 24' having a molded line of weakening 26' therearound. A tab 25' projecting upwardly from a portion of the top wall 24' adjacent to the score line 26' is provided to effect an opening. By lifting and pulling on the tab 25', the central portion of the top wall defined by the score line 26' can be separated from the spout and discarded.

Another important feature of a preferred embodiment of a can end for use with a cap of this invention is the use of the integrally formed rivet 36 shown in FIG. 6. The rivet is formed by successive coining steps.

Figure 25:
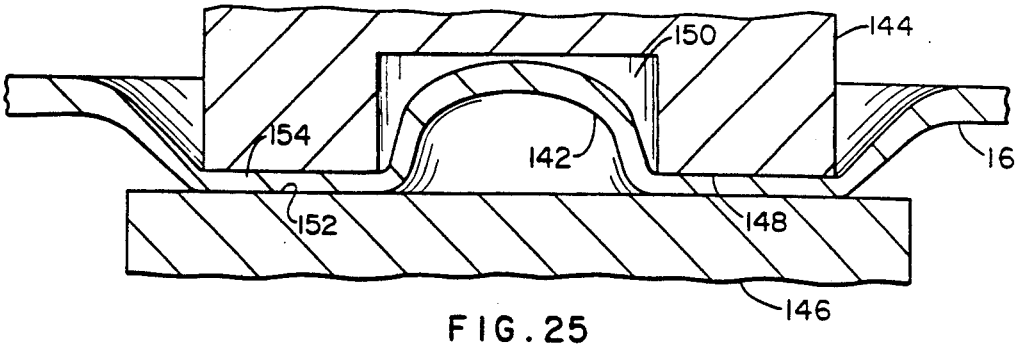
FIG. 25 is a cross-sectional view of a portion of a can end and forming dies at the completion of a first forming step to make a preferred integral rivet in the can end to attach a cap of this invention to the can end.

A first coining step is shown at its completion in FIG. 25. At the beginning of the step, can end wall 16 is disposed between spaced apart coining die 144 and support die 146. Coining die 144 has an annular coining surface 148 around a central opening 150 with the coining surface having a 0.120 inch I.D. and 0.260 inch O.D. Support die 146 has a planar support surface 152. The coining die and support die are adapted for axial movement of one with respect to the other. The dies are then brought together. The end wall is reduced in thickness in the first coined zone 154. Metal displaced therefrom is extruded radially inwardly to form the bubble 142 and outwardly to spring upwardly a portion of the end wall 16 adjacent the exterior of coining die 144.

Figure 26:
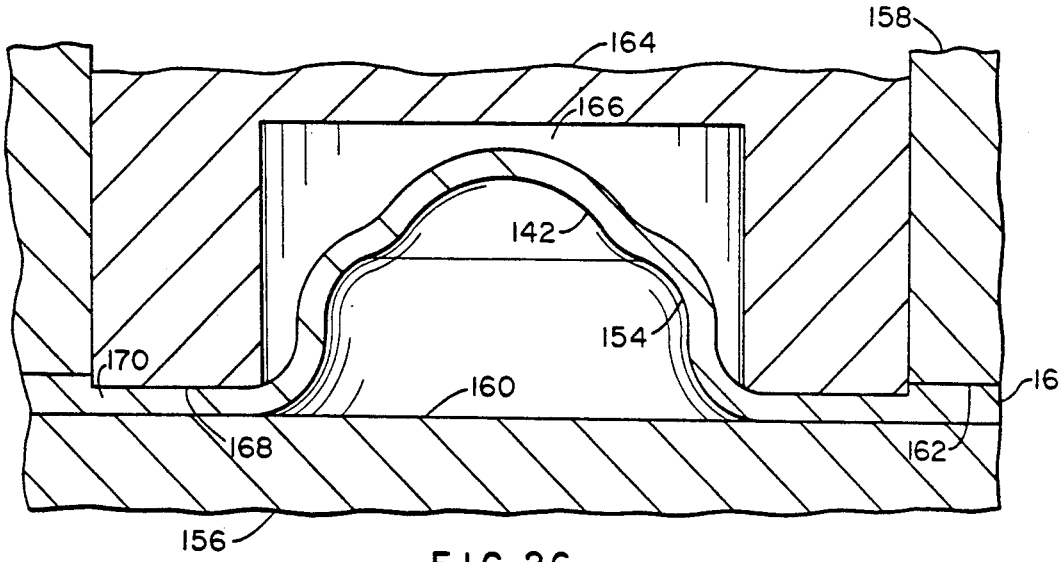
FIG. 26 is a cross-sectional view of the can end portion shown in FIG. 25 and forming dies at the completion of a second forming step.

The completion of the second coining step is shown in FIG. 26. The shape formed in FIG. 25 is first placed between support die 156 and spaced apart hold-down tool 158 and coining die 164. Hold-down tool 158 and coining die 164 are adapted for axial movement independent of one another. Support die 156 has a planar support surface 160 and hold-down tool 158 is cylindrical with an annular planar end surface 162. The hold-down tool is moved axially toward support die 156 with a portion of the upwardly sprung portion of the can end wall 16 therebetween to hold down and flatten such portion. Second coining die 164 having a central opening 166 and an annular coining surface 168 with a 0.270 inch I.D. and a 0.370 inch O.D. therearound is then moved axially downward to coin and thin the wall in a second coined zone 170. The second coined zone is outward of the first coined zone 154, and since end wall 16 outward of the second zone is held down and restrained from movement, the metal displaced from the second coined zone is extruded radially inwardly pushing the first coined zone 154 and bubble 142 upwardly.

Figure 27:
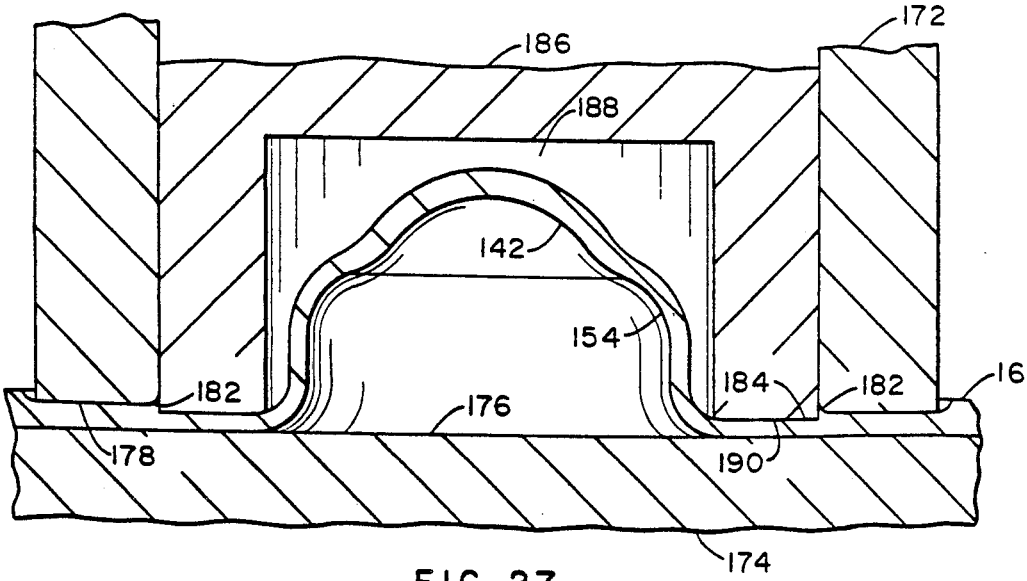
FIG. 27 is a cross-sectional view of the can end portion shown in FIG. 26 and forming dies at the completion of a third forming step.

In the third and final coining step, the height of the bubble 142 and first coined zone 154 is further increased and a recess is formed in the end wall adjacent the upwardly formed wall portion to provide a seat for a cap of this invention. FIG. 27 shows the tooling and end wall at the completion of the final coining step. To perform such step, the formed shape shown in FIG. 26 is positioned between cylindrical hold-down tool 172 and coining die 186 spaced apart from support tool 174. Hold-down tool 172 and coining die 186 are adapted for axial movement independent of one another. Support tool 174 has a planar support surface 176, and hold-down tool 172 has an annular planar end surface 178. The interior corner 180 of the hold-down tool is radiused to provide an upwardly projecting ridge 182 in the end wall 16 adjacent the coined recess 184. The hold-down tool 172 is moved axially toward the support die 174 to hold the formed shape therebetween. Coining die 186 having a central opening 188 and an annular coining surface 190 with a 0.200 inch I.D. and a 0.280 inch O.D. therearound is moved axially against the end wall metal to coin and thin the metal therebelow and thereby form recess 184. The metal displaced by coining the recess is primarily extruded radially inwardly to further increase the height of the bubble 142 and first coined zone 154. A small portion of the displaced metal is extruded radially outwardly, however, to fill the void between the radiused hold-down tool corner 180 and the coining die 186 and thereby form the ridge 182. As finally formed, the bubble section 142 has the same thickness, t, as the end wall 16, the first coined zone 154 is 0.6t, the recess 184 has a thickness of 0.5t and the outermost coined ring under hold-down tool 172 has a thickness of 0.6t.

Figure 28:
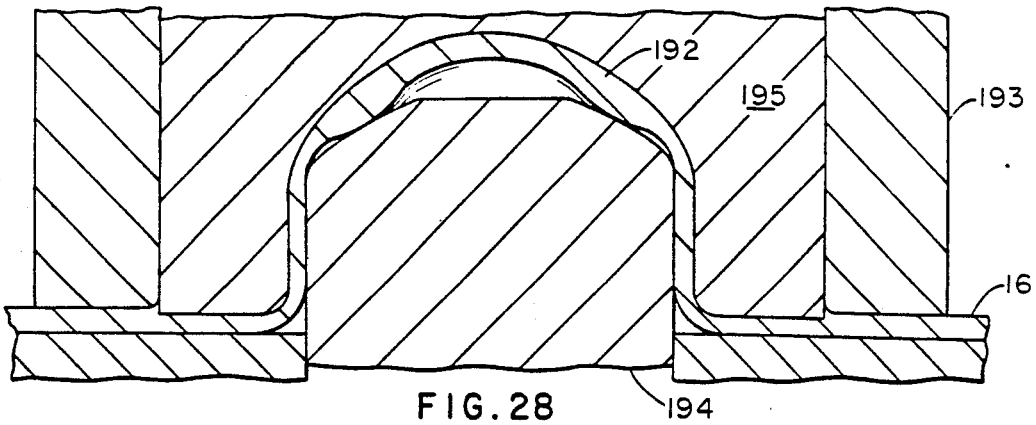
FIG. 28 is a cross-sectional view of the can end portion shown in FIG. 27 and a portion of the tooling at the completion of a reforming step to reform the portion shown in FIG. 27.

The formed end wall shape shown in FIG. 27 can be formed into the rivet 36 shown in FIG. 6. It is preferred, however, to reform the shape into a substantially uniform dome 192, as shown in FIG. 28, prior to forming the rivet. The dome is formed by restraining the end wall 16 against movement with hold-down tooling 193 while a mandrel 194 is forced upwardly against the interior surface of the shape shown in FIG. 27 reforming the shape to the dome configuration of the cavity in female die 195.

Figure 29:
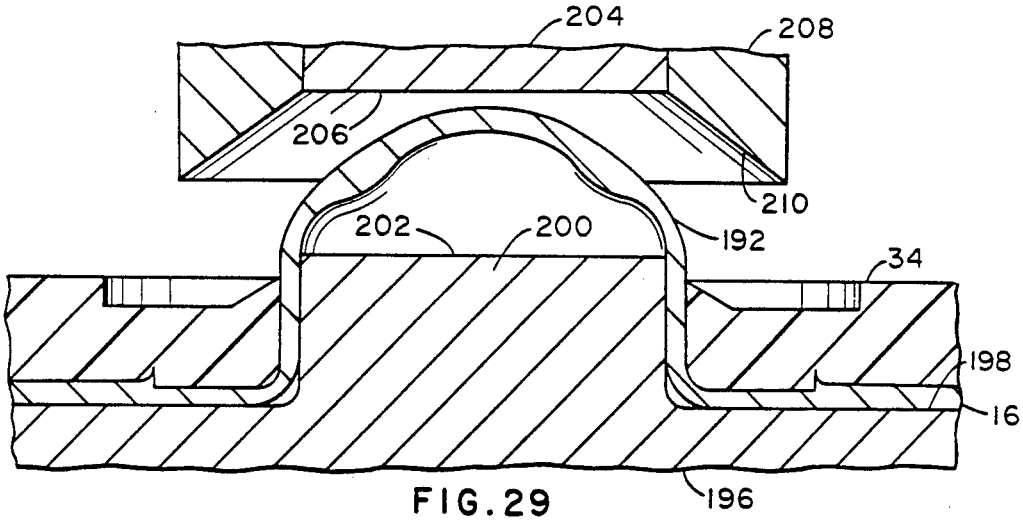
FIG. 29 is a cross-sectional view of an assembly of the can end portion shown in FIG. 28 and a portion of an arm of a cap of this invention thereon with the assembly positioned on tooling preliminary to forming a rivet to attach the cap to the can end.

Rivet 36 is formed by a step referred to as staking. An assembly of the rivet dome 192 and cap is made by inserting the dome through the opening in the cap arms 34, and the assembly is positioned in the staking tooling as shown in FIG. 29. The lower die 196 has a planar support surface 198 to support the can end wall 16 and a cylindrical portion 200 with an upper planar surface 202 thereon extending upwardly therefrom. An upper tool assembly comprising a central cylindrical die 204 having a planar end surface 206 and a hollow cylindrical die 208 having a downwardly and outwardly sloping end surface 210 therearound is positioned coaxially with the lower cylinder portion 200. The cylindrical die 204 and hollow cylindrical die 208 are adapted for independent axial movement.

Figure 30:
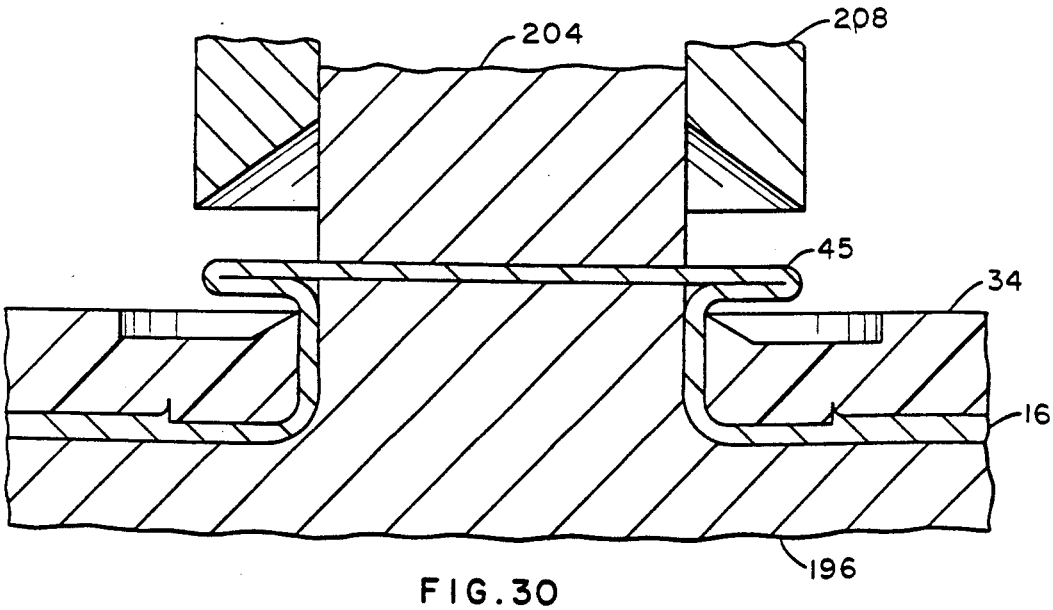
FIG. 30 is a cross-sectional view of the assembly and tooling shown in FIG. 29 at the completion of a first step to form the rivet.
Figure 31:
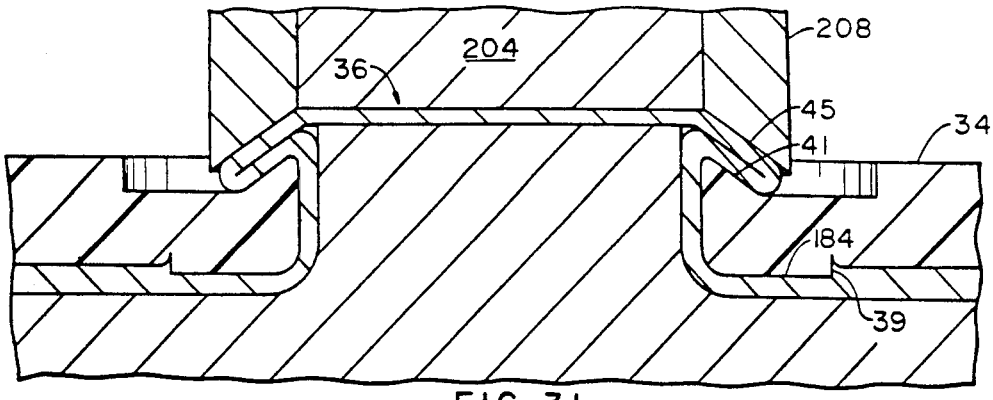
FIG. 31 is a cross-sectional view of the assembly and tooling shown in FIG. 30 at the completion of the final step of forming the rivet head and attaching the cap to the can end.

Upper die 204 is first moved downwardly whereby the dome portion between dies 204 and 196 is first flattened and then thinned. Metal displaced by the thinning extrudes radially outwardly forming the rivet flange 45, as shown in FIG. 30. Die 208 is then moved axially downward a controlled distance, as shown in FIG. 31, whereby rivet flange 45 is bent downwardly to engage the sloping recess surface 41 of the cap arms 34 and press the ledge 39 against the coined recess seat 184. The downward movement of die 208 is controlled to insure that the cap arms 34 are not engaged with the rivet 36 so tightly that rotation of the cap about the rivet is restricted. Upper dies 204 and 208 can be combined into a single die, but it is preferred that they be separate to better control the downward bending of the rivet flange.

Figure 32:
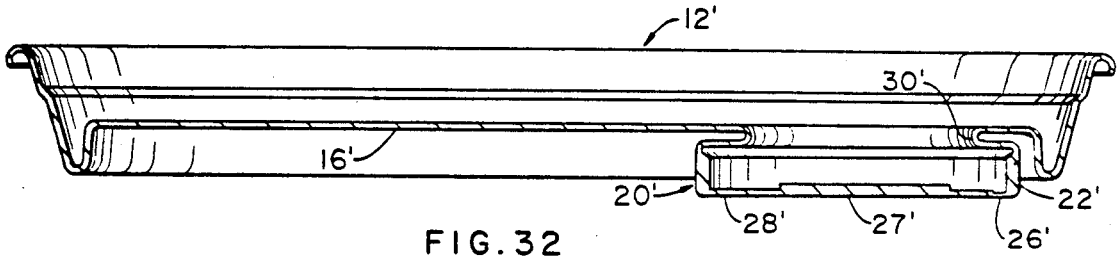
FIG. 32 is a cross-sectional view of an alternate embodiment of a can end having an inwardly projecting spout for use with a cap of this invention.
Figure 33:
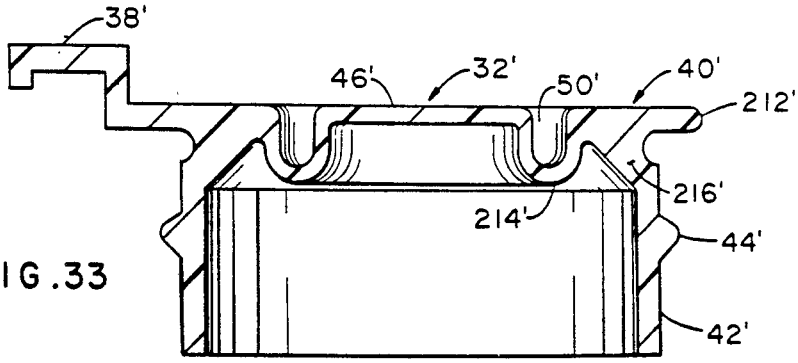
FIG. 33 is a cross-sectional view of an alternate embodiment of a seal portion of a cap of this invention for use with the can end shown in FIG. 32.

In an alternate embodiment of this invention shown in FIG. 32, the can end severable opening panel may be located in a recessed portion of the can end panel. Such a can end closure 12' differs from that shown in FIGS. 1 and 2 only with respect to the spout 20 structure. Can end 12' has a spout 20' depending from end wall 16'. A radiused lip 30' formed from coined metal projects into the spout at the juncture of the spout and the end wall. The spout has an inwardly concave opening panel 27' connected to the spout sidewall 22' by a line of weakness 26' except at an unweakened hinge portion 28'. A cap of this invention for use with the can end shown in FIG. 31 differs from the cap 10 shown in FIGS. 4 and 5 only with respect to seal portion 32. A seal portion 32' suitable for use with the can end shown in FIG. 32 is shown in FIG. 33. The seal portion 32' has a top wall 40' with a skirt 42' depending therefrom. An annular lip 212' projects outwardly from the skirt 42' in line with top wall 40'. An annular groove 50' is defined by an arcuate portion 214' in the top wall with a central disc portion 46' inwardly of the groove. A downwardly and outwardly sloping ledge 44' spaced away from the lip 212' projects outwardly from the skirt 42'. An annular ring 216' having a triangular cross section is connected to the skirt 42' and top wall 40' at the junction thereof. A lifting tab 38' projects upwardly from the top wall 40' along an edge portion thereof. The seal portion 32' is connected to arms identical to arms 34 shown in FIGS. 4, 6 and 24.

Figure 34:
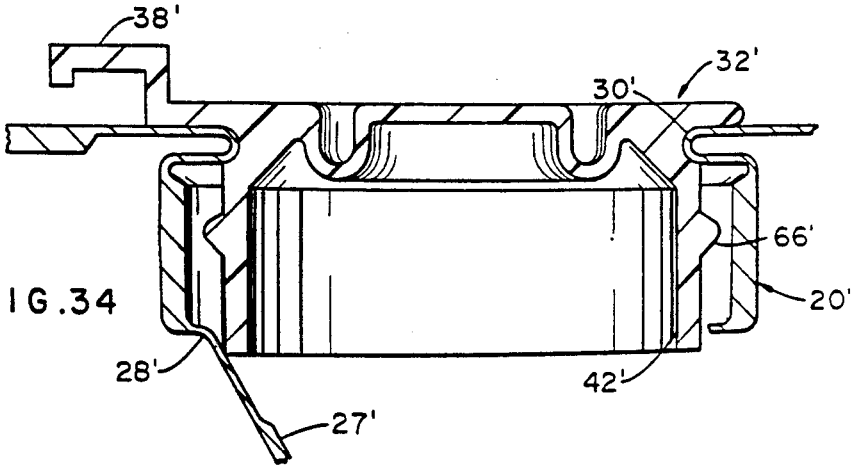
FIG. 34 is a cross-sectional view of the sealing portion shown in FIG. 33 in sealing engagement with the can end shown in FIG. 32.

Referring now to FIG. 34, the seal portion 32' is shown in combination with spout 20' after opening panel 27' has been partially separated from the spout and bent inwardly at hinge 28'. Such an opening is effected by positioning the seal portion 32' in coaxial alignment with spout 20' and pressing downwardly. Skirt 42' flexes inwardly as sloping surface 66' contacts lip 30', and after clearing the lip, the skirt flexes outwardly to be aligned adjacent the score line 26' above the opening panel 27'. Continued downward pressure causes fracture of the score line and bends the opening panel 27' inwardly at the hinge 28'. To gain access to the can contents, the tab 38' may be lifted to remove seal portion 32'.

Figure 35:
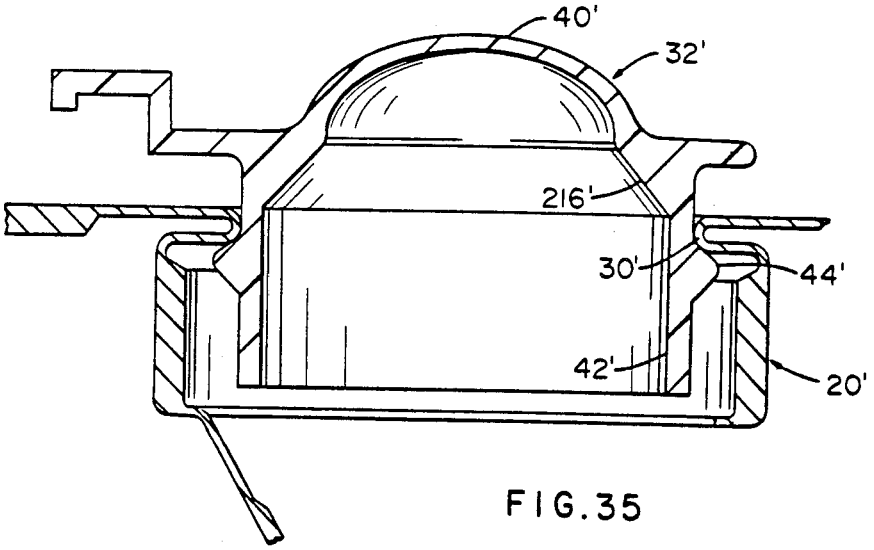
FIG. 35 is a cross-sectional view of the sealing portion in sealing engagement with the can end as shown in FIG. 34 with a portion of the end wall of the sealing portion inverted from the internal pressure within the can.

To reseal the opening, the seal portion 32' is again aligned with the spout 20' and pushed downwardly until ledge 44' clears spout lip 30'. An initial low pressure seal is established by compression of skirt wall 42' against the smooth radiused lip 30'. As internal pressure increases, the seal portion 32' is lifted until ledge 44' contacts the underside of lip 30' and thereafter a sealing engagement is maintained between the ledge and lip, as shown in FIG. 35. It is noted that annular groove 50' is provided only to give a clear indication that the can is sealed by inversion of the groove from the action of internal pressure. If desired, the groove can be eliminated without detrimentally affecting the sealing characteristics.

As previously discussed, the downward angle of inclination from horizontal of ledge 44' is important. Since the internal pressure acting on a cap of this alternate embodiment will tend to rotate the skirt 42' so as to increase such angle, stiffener ring 216' is provided at the junction of skirt 42' and top wall 40' to prevent such rotation.

It is noted that it is not essential that the opener-reseal device be rotatably attached to the can end panel to be within the scope of this invention. For example, the device may be tightly secured by alternate means, such as a rivet or a suitable adhesive, for example, with the cap portion 32 overlaying the opening panel in an unengaged position. After opening the can in a manner as previously described with respect to the preferred embodiment, the cap portion may be manipulated away from the opening by flexing the arm so as to gain access to the can contents. Furthermore, the device may be rigidly attached to the can end with the opener-reseal portion stored alongside the spout, as shown in FIG. 1. By providing an arm or arms 34 of sufficient flexibility, the opener-reseal portion 32 can be manipulated to overlay the spout to effect opening or resealing.

From the foregoing, it may be seen that numerous modifications and variations may be effected without departing from the spirit and scope of the invention.

What is claimed is:

1. A method of making an end closure for a container comprising the steps of:

providing a metal blank having an end wall and means for attaching the end wall to the open mouth of a container;

forming an upwardly projecting spout having a sidewall and an end wall in the end wall of the blank:

coining a marginal portion of the end wall around the periphery of the spout to extrude metal outwardly to form a continuous lip on the spout, with the lip having a top wall, a bottom wall, and an outwardly arcuate wall connecting the top and bottom walls.

2. A method of forming an end closure as claimed in claim 1 wherein the step of forming the spout includes a first step of forming an upwardly projecting bubble having a lesser diameter than the closure end wall in a portion of the closure end wall near the periphery thereof.

3. A method of forming an end closure as claimed in claim 2 whereby the step of forming the spout includes a step of reforming the bubble into a shape which is frustoconical in cross section having an outwardly and downwardly sloping sidewall and coining a portion of the sidewall to be subsequently formed into the lip to produce a length having zones of varying thickness to insure that when the lip is subsequently formed it will conform to a desired contour.

4. A method of forming an end closure as claimed in claim 3 whereby the step of providing a metal blank further includes providing a metal blank having a sidewall projecting upwardly from the margin of the end wall as the means for attaching the end wall to the container mouth, and forming a downwardly projecting stiffening groove at the junction of the closure end wall and sidewall in a step which is subsequent to the step of reforming the bubble into a frustoconical shape.

5. A method of forming an end closure as claimed in claim 4 whereby the groove is formed in two stages with the groove formed to have a first radius in a first stage and is reformed in a second stage to have a second radius smaller than the first to provide a groove affording a greater resistance to buckling.

6. A method of forming an end closure as claimed in claim 4 whereby the step of providing a metal blank includes providing a blank having an outwardly projecting step in the sidewall.

7. A method of forming an end closure as claimed in claim 1 which further includes forming a score in the spout end wall which defines the margin of an opening panel which is at least partially separable from the spout end wall by fracturing the score.

8. A method of forming an end closure as claimed in claim 7 which further includes forming the opening panel portion of the spout end wall to be slightly concave downwardly.

9. A method of forming an end closure as claimed in claim 7 which further includes reforming the outer arcuate lip wall so as to have a smaller outer radius.

10. A method of forming an end closure as claimed in claim 1 which further includes forming an upwardly projecting integral rivet shank for attaching a plastic cap adapted for a sealing engagement with the spout to the closure end.

11. A method of forming an end closure as claimed in claim 10 which further includes providing a plastic cap adapted for sealing engagement with the spout lip to seal an opening in the spout end and further adapted with an arm having a hole therein for attaching the cap to the container closure and positioning the rivet shank in the cap arm hole and staking the rivet thereafter to form a head and thereby attach the cap to the closure.

12. A method of forming an end closure as claimed in claim 11 whereby the step of providing the plastic cap includes providing the cap arm with a portion around the hole which slopes downwardly from the top surface of the arm and the staking step includes staking the rivet to form a head which slopes downwardly engaging the downwardly sloping arm portion between the head and the container closure end wall in a manner which permits rotation of the cap about the rivet shaft.

* * * * *